US005630317A

United States Patent [19]

Takamura et al.

[11] Patent Number: 5,630,317

[45] Date of Patent: May 20, 1997

[54] CONTROLLER FOR HYDRAULIC DRIVE MACHINE

[75] Inventors: Fujitoshi Takamura, Hirakata; Tetsuya Nakayama, Chigasaki; Shuki Akushichi, Sagamihara, all of Japan

[73] Assignee: Kabushiki Kaisha Komatsu Seisakusho, Japan

[21] Appl. No.: 531,942

[22] PCT Filed: Mar. 28, 1994

[86] PCT No.: PCT/JP94/00491

§ 371 Date: Sep. 21, 1995

§ 102(e) Date: Sep. 21, 1995

[87] PCT Pub. No.: WO94/23213

PCT Pub. Date: Oct. 13, 1994

[30] Foreign Application Priority Data

| | | | |
|---|---|---|---|
| Mar. 26, 1993 | [JP] | Japan | 5-068609 |
| Mar. 26, 1993 | [JP] | Japan | 5-068611 |
| Mar. 26, 1993 | [JP] | Japan | 5-068612 |
| Mar. 26, 1993 | [JP] | Japan | 5-068613 |

[51] Int. Cl.[6] ..... F16D 31/02

[52] U.S. Cl. ..... 60/445; 60/449; 60/452

[58] Field of Search ..... 60/433, 434, 445, 60/449, 452

[56] References Cited

U.S. PATENT DOCUMENTS

| | | | |
|---|---|---|---|
| 4,116,587 | 9/1978 | Liesener | 60/452 |
| 4,139,987 | 2/1979 | Budzich | 60/452 |
| 5,077,975 | 1/1992 | Kauss | 60/449 |
| 5,085,051 | 2/1992 | Hirata | 60/452 |
| 5,267,440 | 12/1993 | Nakamura et al. | 60/452 |
| 5,285,642 | 2/1994 | Watanabe et al. | 60/452 |

FOREIGN PATENT DOCUMENTS

| | | | |
|---|---|---|---|
| 276904 | 3/1990 | Japan . | |
| 2164941 | 6/1990 | Japan . | |
| 285302 | 10/1992 | Japan | 60/445 |

OTHER PUBLICATIONS

PCT Publication No. WO 92/06306 published Apr. 16, 1992 (Abstract).

*Primary Examiner*—F. Daniel Lopez

*Attorney, Agent, or Firm*—Greer, Burns & Crain, Ltd.

[57] ABSTRACT

This invention aims to improve the operability in a hydraulic drive machine. According to a load Pp on work machine actuators 3 and 4, a differential pressure of a discharge pressure Pp of a hydraulic pump and a load pressure PLS is varied. Further, the differential pressure is varied so that the differential pressure between the discharge pressure Pp of the hydraulic pump 2 and the load pressure PLS decreases as the load Pp on the work machine actuators 3 and 4 increases and a rotational speed $\epsilon E$ of an engine decreases. Furthermore, the rotational speed $\epsilon E$ of the engine 1, discharge pressure Pp of the hydraulic pump 2, the operation amounts S1 and S2 of the various operation levers are detected, respectively, the absorbing torque of the hydraulic pump 2 is set based on the detected rotational speed $\epsilon E$ and a target rotational speed $\epsilon ET$, and the differential pressure between the discharge pressure Pp of the hydraulic pump 2 and the load pressure PLS is varied based on the detected values and the torque set value. By varying the differential pressure, it is possible to realize an optimal lever operability suitable for the current working conditions, and thus possible to remarkably improve the work efficiency.

14 Claims, 7 Drawing Sheets

CONTROLLER FOR HYDRAULIC DRIVE MACHINE

TECHNICAL FIELD

The present invention relates to a controller for a hydraulic drive machine including construction machines such as hydraulic shovels, and relates in particular to a controller that makes it possible to vary an amount of change in a drive velocity of a work machine actuator per fixed amount of operation of the operation amount of a flow rate operation valve according to operating conditions of the hydraulic drive machine.

BACKGROUND ART

Conventionally, control techniques for varying a differential pressure between a load pressure of work machine actuators and a discharge pressure of a hydraulic pump according to an externally designated work mode indicating a type of work in order to obtain an operability for operation levers that corresponds to the nature of the work of a construction machine have been disclosed in, for example, Japanese Patent Application Laid-Open No. 2-76904.

With this publicly disclosed technology, it is possible, when the work mode is varied from "normal work" mode to "micro operation" mode, to perform finer work suitable for the "micro operation" mode by making the aforementioned differential pressure smaller than in the case of the "normal work," and by making the change in the drive velocity of the work machine actuators per fixed amount of operation of the operation levers smaller than in the case of the "normal work."

Japanese Patent Application Laid-Open No. 2-164941 also discloses this type of control system, and involves effecting control such that the aforementioned differential pressure is reduced in accordance with a reduction in the rotational speed of the engine, thereby increasing the so-called metering region, which decreases as the engine rotational speed decreases (or, to put it another way, decreases the dead band that increases as the rotational speed decreases), and thus improving the operability of the operation levers.

In this way, these conventional techniques are control methods that vary the differential pressure depending on the work mode or engine rotational speed, that thereby vary the relationship (hereafter referred to as the "operating characteristics") between the work machine actuator velocity and the operation amounts of the operation levers, and that consequently improve the operability of the operation levers; these conventional techniques, however, only involve a one-to-one correspondence between the change in the differential pressure and the work mode or engine rotational speed, and do not involve controlling the correlation with the actual load on the work machine actuators.

However, hydraulic shovels and the like are generally equipped with a device that effects equivalent horsepower control or the like so that the absorbing torque of a hydraulic pump is matched with the engine output torque (see FIG. 7(*c*)), and that controls the discharge quantity of the hydraulic pump according to the so-called PQ curve of FIG. 7(*b*) so that the absorbing torque value at this matching point is obtained. Such devices are well-known devices which are constructed with, for example, a TVC valve as a main component.

However, when control is effected in this way so that the torque is kept at or below a certain value, then when the hydraulic pump discharge pressure Pp, that is, the load on the work machine actuators, is high, the hydraulic pump quantity of discharge Qp is low, as shown by the P2 (>P1) of FIG. 7(*b*). For this reason, as shown in FIG. 7(*a*), compared to when the load pressure Pp is, on the contrary, low, at P1, when the load pressure Pp is high, at P2, the work machine drive velocity v is affected by the low quantity of discharge Qp, and is kept low, as shown by the break line, and the dead band increases and lever operation is greatly degraded.

With the conventional techniques, moreover, controlling the differential pressure according to the work mode does not involve effecting control according to the actual work machine drive state pertaining to the work machine. Specifically, when there are a plurality of work machines, the operating characteristics required for each one is different, and it is not possible to meet these requirements by setting a one-to-one correspondence between the differential pressure and the work mode. An example of a case in which there are different requirements is one in which work machine actuators for excavation should be driven as "normal work," but since the shape of the land is irregular, work machine actuators for travel should be driven as "micro operation." In this case, in the past, the work mode designation had to be varied manually every time there was a switch from excavation work to travel work, and vice versa, which was inconvenient in that it complicated operation and increased the burden on the operator.

With the foregoing in view, the first object of the present invention is to provide a controller that affords better operability than in the past by controlling the aforementioned differential pressure according to the drive states and the like of the individual work machines or according to the load on the work machine actuators.

The aforementioned prior art, moreover, only involves varying the differential pressure in a one-to-one correspondence with the work mode or engine rotational speed, and does not involve effecting control by taking into account the effects of pressure oil leaks in the actual hydraulic circuit.

Specifically, an increase in the load on the work machine actuators is accompanied by an increase in pressure oil leakage in the hydraulic pipe lines between the work machine actuators and the operation valves (flow rate control valves), and thus by a substantial decrease in the volume efficiency of the hydraulic pump. A reduction in engine rotational speed, moreover, is accompanied by an increase in the ratio of the leakage flow rate to the pump discharge flow rate, and thus by a marked decrease in the aforementioned volume efficiency. The actual velocity of the work machine actuators is therefore decreased, and the relationship with the actual operating characteristics is considerably varied. The desired operating characteristics consequently cannot be obtained, and the operability is degraded.

With the conventional techniques, moreover, decreasing the differential pressure according to the work mode or the engine rotational speed does not involve effecting control according to the actual operating conditions of the operation levers. For example, when all of a plurality of operation valves (flow rate control valves) are in a neutral position and a conventional technique is used directly, a phenomenon called "jumping," in which the work machine actuators move suddenly when operation lever operation is started, occurs at high engine rotational speeds, and at low engine rotational speeds an increase in dead time or dead band occurs when operation lever operation is started; in either case, the operability is degraded.

With the foregoing in view, the second object of the present invention is to provide a device that does not undergo any operability degradation even in the event of a pressure oil leak, and that does not undergo any operability degradation when the operation levers are operated from a neutral position.

The aforementioned conventional techniques involve nothing more than varying the differential pressure in a one-to-one correspondence with the work mode or engine rotational speed, and are not based on the premise of matching the engine output torque with the hydraulic pump absorbing torque.

Accordingly, when applied to a hydraulic shovel or the like, which has engine output torque limitations, engine failure or the like occurs when the load on the work machines becomes great, and work therefore cannot be continued, which is inconvenient.

With the foregoing in view, the third object of the present invention is to provide a device that makes it possible to prevent inconveniences such as engine failure and that improves operability by controlling the aforementioned differential pressure while matching the engine output torque and the hydraulic pump absorbing torque.

The aforementioned conventional techniques, moreover, specifically involve providing a valve for differential pressure control to the hydraulic circuit that controls the hydraulic pump, and controlling the hydraulic pump swash plate swash angle by means of this differential pressure control valve so that a differential pressure corresponding to the engine rotational speed or work mode may be obtained. Such swash plate control, however, is not based on the premise that the engine output torque matches the hydraulic pump absorbing torque.

Consequently, when applied as is to a hydraulic shovel or the like that has engine output torque limitations, engine failure or the like occurs when the load on the work machine becomes considerable, and work cannot be continued, which is inconvenient.

On the other hand, with a hydraulic shovel or the like, there are cases in which a control valve for controlling the pump absorbing torque that controls the hydraulic pump swash plate swash angle so that the hydraulic pump absorbing torque matches the engine output torque is provided to the hydraulic circuit that controls the hydraulic pump. However, when the absorbing torque control valve and the differential pressure control valve are both present, but with no interrelationship, and the hydraulic pump is controlled, there are cases in which, depending on the operating conditions, the torque limitations come into play, and the operation lever operability is degraded.

With the foregoing in view, the fourth object of the present invention is to provide a device that makes it possible to prevent such inconveniences as engine failure, and to thereby improve operability, by controlling the differential pressure with the differential pressure control valve, taking into account the aforementioned absorbing torque, while matching the engine output torque with the hydraulic pump absorbing torque by means of the absorbing torque control valve.

SUMMARY OF THE INVENTION

To achieve the first object, therefore, the first invention of this invention provides a controller for a hydraulic drive machine, which includes a hydraulic pump driven by a motor, a plurality of hydraulic actuators driven by the supply of the discharge pressure oil of the hydraulic pump via a pressure oil supply line, and a plurality of flow rate control valves for controlling, in accordance with operation amounts, the flow rate of the pressure oil supplied to the plurality of work machine actuators, which controls the discharge flow rate of the hydraulic pump so that a differential pressure between a discharge pressure of the hydraulic pump and a load pressure of the plurality of work machine actuators becomes a set value; and which comprises:

pressure detection means for detecting the discharge pressure of the hydraulic pump or the load pressure of the plurality of work machine actuators; and means for varying the differential pressure set value so that the differential pressure set value decreases as the pressure detected by the pressure detection means increases.

With the structure of the first invention, it is possible to control the expansion of the operating characteristics dead band that is brought about by an increase in the load on the work machine actuators, and thereby possible to improve the lever operability, by means of the fact that an increase in the pressure detected by the pressure detection means is accompanied by a decrease in the differential pressure set value.

Similarly, moreover, to achieve the first object, the second invention of this invention provides a controller for a hydraulic drive machine that is similar to that of the first invention, which comprises:

pressure detection means for detecting the load pressure of the plurality of work machine actuators or the discharge pressure of the hydraulic pump;

operation amount detection means for detecting the operation amounts of the plurality of flow rate control valves; and means for varying the differential pressure set value so that the differential pressure set value decreases as the pressure detected by the pressure detection means increases, and for varying the differential pressure set value so that the differential pressure set value decreases as the operation amounts detected by the operation amount detection means increase while taking as the minimum value the differential pressure set value determined according to the pressure detection means.

According to the structure of the second invention, the differential pressure set value corresponding to the pressure detected by the pressure detection means is taken as the minimum value, and an increase in the operation amounts detected by the operation amount detection means is accompanied by a decrease in the differential pressure set value. Specifically, when the differential pressure is varied in a one-to-one correspondence by means of the load pressure alone, load pressure variation is readily generated in the work machine micro velocity region in which the operation amounts are low, and the change in the drive velocity of the work machine actuator caused by this variation is discomforting to the operator. When the operation amount is low, therefore, it is possible to remove the discomfort by ensuring that the drive velocity variation is not generated, i.e., the differential pressure does not vary.

Similarly, to achieve the first object, the third invention of this invention provides the similar device as that of the first and second inventions, which comprises:

pressure detection means for detecting the load pressure of the plurality of work machine actuators or the discharge pressure of the hydraulic pump;

operation amount detection means for detecting the operation amounts of the plurality of flow rate control valves;

work machine type detection means for detecting a type of work machine actuator currently being driven from among the plurality of work machine actuators; and means for varying the differential pressure set value based on the type of work machine actuator detected by the work machine actuator detection means, on the operation amounts detected by the operation amount detection means, and on the pressure detected by the pressure detection means.

According to the structure of the third invention, the differential pressure set value is varied based on the type of work machine actuator detected by the work machine actuator detection means, on the operation amounts detected by the operation amount detection means, and on the pressure detected by the pressure detection means.

Specifically, required operation characteristics which vary depending on an actual work condition of the work machine actuator can be met by varying the differential pressure according to the type of work machines.

To achieve the second object, moreover, the fourth invention of this invention provides the similar device, which comprises:

pressure detection means for detecting a load pressure of the plurality of work machine actuators or the discharge pressure of the hydraulic pump;

rotational speed detection means for detecting the rotational speed of the motor; and means for varying the differential pressure set value so that the differential pressure set value increases as the pressure detected by the pressure detection means increases and the rotational speed detected by the rotational speed detection means decreases.

According to the structure of the fourth invention, the differential pressure set value varies in such a way that the differential pressure set value increases as the pressure detected by the pressure detection means increases and the rotational speed detected by the rotational speed detection means decreases. Specifically, since the differential pressure set value varies depending on the factors that affect pressure oil leakage in the hydraulic circuit, such as pressure and motor rotational speed, the operability of the flow rate control valve (operation lever for controlling the flow rate control valve) is improved.

To achieve the second object, moreover, the fifth invention of this invention provides the similar device, which comprises:

neutral position detection means for detecting a fact that operating positions of the plurality of flow rate control valves are in neutral positions;

rotational speed detection means for detecting a rotational speed of the motor; and means for, when the operating positions of all of the plurality of flow rate control valves have been detected by the neutral position detection means to have been in the neutral position, varying the differential pressure set value so that the differential pressure set value is made lower than the differential pressure set value when any of the plurality of flow rate control valves is being operated, and so that the differential pressure set value decreases as the rotational speed detected by the rotational speed detection means increases.

According to the structure of the fifth invention, when the operating positions of all of the plurality of flow rate control valves have been detected by the neutral position detection means to have been in the neutral position, then the differential pressure set value changes so that it is made lower than the differential pressure set value when any of the plurality of flow rate control valves is operated, and so that the differential pressure set value decreases as the rotational speed detected by the rotational speed detection means increases. Specifically, since the differential pressure in the neutral position is smaller than the differential pressure in a position other than the neutral, and is set according to the rotational speed of the engine, even if the flow rate control valve operation is started from the neutral position, there is no "jumping" phenomenon when operation is begun at high speeds, and there is no increase in dead time or dead band at low speeds, so that operability when operation is begun is improved.

To achieve the third object, the sixth invention of this invention provides the similar device, in which the operation amounts of the plurality of flow rate control valves, the load pressure of the plurality of work machine actuators or the discharge output of the hydraulic pump, and the rotational speed of the motor are each detected, the absorbing torque of the hydraulic pump is set based on the target rotational speed of the motor, and the differential pressure set value is varied in accordance with these detected and set values.

Specifically, according to the structure of the sixth invention, the rotational speed of the motor, the hydraulic pump discharge pressure or the load pressure of the plurality of work machine actuators, and the operation amounts of the plurality of flow rate control valves are each detected, the hydraulic pump absorbing torque is set based on the target rotational speed of the motor, and the differential pressure set value is varied in accordance with these detected and set values. Since the differential pressure is varied in this way taking the hydraulic pump absorbing torque into consideration, a state in which operation cannot be continued due to inconveniences such as engine failure is prevented.

To achieve the fourth object, the seventh invention of this invention provides the similar device, which comprises:

rotational speed detection means for detecting the rotational speed of the motor;

discharge pressure detection means for detecting the discharge pressure of the hydraulic pump;

load pressure detection means for detecting the load pressure of the plurality of work machine actuators;

operation amount detection means for detecting the operation amounts of the plurality of flow rate control valves;

a controller for setting the hydraulic pump absorbing torque based on the target rotational speed of the motor, for setting the differential pressure based on the operation amount detected values of the operation amount detection means, the pressure detected values of the load pressure detection means or the discharge pressure detection means, the rotational speed detected value of the rotational speed detection means, and the set absorbing torque, and for outputting control signals corresponding to these absorbing torque and differential pressure set values;

a torque control valve for controlling a swash plate swash angle of the hydraulic pump, so that the absorbing torque set value is obtained, based on the input from the controller of detected signals corresponding to the discharge pressure detected value of the discharge pressure detection means and of control signals corresponding to the absorbing torque set value; and a differential pressure control valve for controlling the swash plate swash angle of the hydraulic pump, so that the differential pressure set value is obtained, based on the input from the controller of detected signals corresponding to the pressure detected values of the load pressure detection means and the discharge pressure detection means and of a control signal corresponding to the differential pressure set value.

Specifically, according to the structure of the seventh invention, a control signal corresponding to the absorbing torque set value is input from the controller, a detected signal corresponding to the discharge pressure detected value of the discharge pressure detection means is input, and, based on these signals, the hydraulic pump swash plate swash angle is controlled by the torque control valve so that the absorbing torque set value is obtained. Meanwhile, a control signal corresponding to the differential pressure set value is input, detection signals corresponding to the pressure detected values of the load pressure detection means and the discharge pressure detection means are input, and, based on these signals, the hydraulic pump swash plate swash angle is controlled by the differential pressure control valve so that the differential pressure set value is obtained. In this way, the swash plate is controlled by the torque control valve so that the set absorbing torque is obtained, and the swash plate is controlled by the differential pressure control valve, taking the absorbing torque into consideration, so that the differential pressure is varied; this prevents a condition in which operation cannot be continued due to inconveniences such as engine failure, and improves the operability of the operation levers.

BEST MODE FOR CARRYING OUT THE INVENTION

Next, an embodiment of the controller for a hydraulic drive machine which pertains to the present invention is described with reference to the figures. In the embodiment, furthermore, a hydraulic shovel is assumed to be the hydraulic drive machine.

Figure 1:
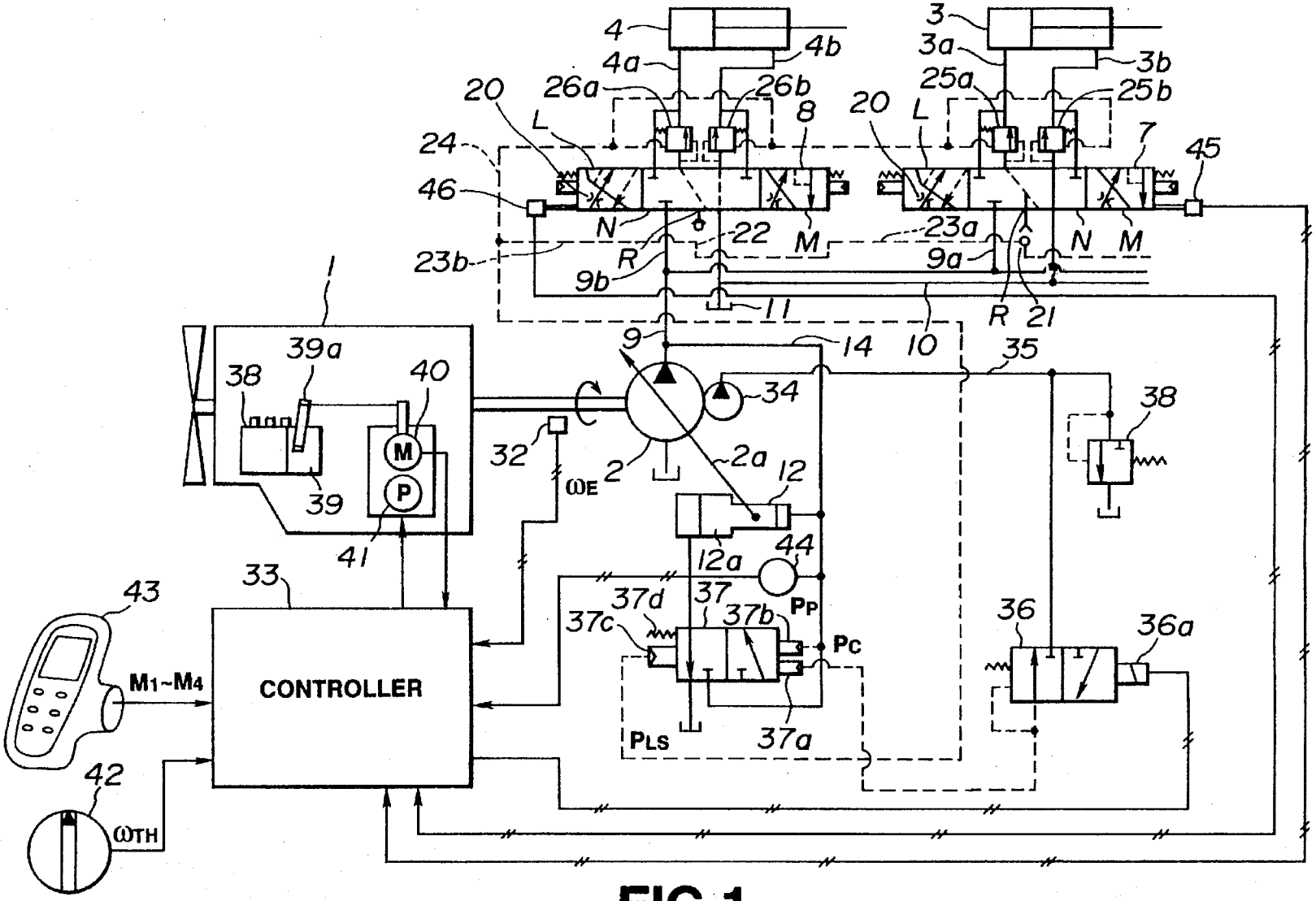
FIG. 1 is a circuit diagram which depicts the structure of the work machine hydraulic circuit in the embodiment of the controller for a hydraulic drive machine which pertains to the present invention.

FIG. 1 shows the structure of the work machine hydraulic circuit that drives the various work machines (booms, arms, etc.) of the hydraulic shovel. With the embodiment, moreover, in order to avoid complicated figures, only two operation valves corresponding to two types of work machines are shown.

As shown in the same figure, a variable displacement hydraulic pump 2 is driven by an engine 1, and the swash angle of a swash plate 2*a* is varied according to the movement of a piston 12*a* of a swash plate drive regulator 12. The discharge amount D per hydraulic pump 2 revolution (cc/rev) is varied according to the change in the swash angle of this swash plate 2*a*. The engine 1 is provided with a rotation sensor 32 for detecting the rotational speed (rpm) $\epsilon E$ of the engine 1, and the detected signal $\epsilon E$ of this rotation sensor 32 is sent to a controller 33.

The discharge pressure oil of the hydraulic pump 2 is supplied to a pipe line 9 and to operation valves 7 and 8 via pipe lines 9*a* and 9*b*, respectively, formed by the branching of the pipe line 9; Spools of the operation valves 7 and 8 are driven according to the operation amounts S1 and S2 of operation levers which are not shown, aperture areas A1 and A2 of the operation valves vary depending on the extent of movement of the spools, and a flow rate of pressure oil corresponding to this change is supplied to hydraulic cylinders 3 and 4, respectively, that constitute work machine actuators. At this time, the pressure oil that is circulated from the operation valve 7 is supplied via pipe lines 3*a* and 3*b* into the cylinder chamber on the extended side and the cylinder chamber on the retracted side, respectively, of the hydraulic cylinder 3, and the hydraulic cylinder 3 is thereby extended and retracted, respectively.

In the same manner, the pressure oil circulated from the operation valve 8 is supplied to the cylinder chamber on the extended side and to the cylinder chamber on the retracted side of the hydraulic cylinder 4 via lines 4*a* and 4*b*, and the hydraulic cylinder 4 is thereby extended and retracted.

The operation valves 7 and 8 have positions N, M, and L; the pump port to which the pressure oil discharged from the pump 2 is flows in is in a closed state in the neutral position N, and the pressure oil that flows through the operation valves from the switching position N to the switching position L or M is throttled by a rotring variable throttle 20 that is provided to the spool. In the switching positions L and M, moreover, the throttle 20 has a fixed area, and the load pressure of the hydraulic cylinders 3 and 4, i.e., the pressure at the output side of pressure reducing valves 25*a*, 25*b*, 26*a*, and 26*b* that are provided to, respectively, the pipe lines 3*a*, 3*b*, 4*a*, and 4*b*, is applied to check valves 21 and 22 via a port R.

The check valve 21 is connected to a pilot pipe line 23*a*, and this pilot line 23*a* is connected to a pilot line 23*b*. The check valve 22 is connected to the pilot pipe line 23*b*. The pilot line 23*b* is connected to a pilot pipe line 24. The pressure oil on the high pressure PLS side of the hydraulic cylinders 3 and 4 is supplied to the pilot pipe line 24 via one of the check valves 21 and 22. The pilot pipe line 24 is connected to the spring position side of the pressure reducing valves 25*a*, 25*b*, 26*a*, and 26*b*, and the load pressure PLS on the high pressure side of the hydraulic cylinders 3 and 4 is therefore applied to the spring position side of the pressure reducing valves 25*a*, 25*b*, 26*a*, and 26*b*. The pressure oil on the input side of the pressure reducing valves, i.e., the pressure on the output side of the operation valves 7 and 8, is applied to a side opposed to the spring side as a pilot pressure. A pipe line 10, moreover, is provided for releasing the pressure oil of the operation valves 7 and 8 into a tank 11.

A fixed capacitive hydraulic pump 34 discharges pressure oil at a specific pressure; this discharged pressure oil is supplied as control pressure Pc pressure oil to a pilot port 37*a* of a control valve 37 via a pipe line 35 and a control valve 36 (the so-called LS-EPC valve).

Here, the position of the control valve 36 is varied in accordance with a control signal received by an electromagnetic solenoid 36*a* from a controller 33, whereby the flow rate of the pressure oil supplied to the pilot port 36*a* is varied.

A relief valve 38 is furthermore provided to the pipe line 35, and relief is effected by means of the relief valve 38 when the pressure of the discharge pressure oil of the hydraulic pump 34 reaches or exceeds the pressure set by the relief valve 38.

The pipe line 9 on the discharge side of the hydraulic pump 2 branches into a pilot pipe line 14; this pilot pipe line 14 is connected to a cylinder chamber on the small diameter side of a regulator 12, and is connected to a pilot port 37*b* of the control valve 37. The pilot pipe line 23*b* is extended, and is connected to a pilot port 37*c* on the side on which a spring 37*d* of the control valve 37 is positioned. For this reason, the discharge pressure Pp of the hydraulic pump 2 and the control pressure Pc from the control valve 36 are applied to an end of the control valve 37 where the spring 37*d* is not located, the pressure PLS on the high pressure sides of the hydraulic cylinders 3 and 4 is applied as a pilot pressure to the other end of the control valve 37, where the spring 37*d* is located, and the energizing pressure of the spring 37*d* is applied as an offsetting pressure. The position of the control valve 37 is switched according to the differential pressure of the pressures applied to each end of the control valve 37, the discharge flow pressure oil corresponding to the switching position is supplied or discharged to the cylinder on the large diameter side of the regulator 12, and the swash angle of the swash plate 2*a* is controlled.

In this case, the swash angle of the swash plate 2*a* is controlled so that the differential pressure ΔPLS between the hydraulic pump pressure Pp and the cylinder load pressure PLS is maintained at the set value, as described below. In this case, the differential pressure ΔPLS set value is varied according to the control pressure Pc, i.e., the control signal sent to the electromagnetic solenoid 36*a* from the controller 33.

The relationship between the pressures Pp and PLS and the discharge amount (volume) D of the hydraulic pump 2 at this time is expressed by formula (1) below.

$$D=C\cdot A\cdot\sqrt{(Pp-PLS)} \quad (1)$$

Here, C is a constant, and A is the aperture area of the throttle 20.

A fuel injection pump 38 and a governor 39 are both provided to the engine 1. It is driven by a motor 40 or a fuel control lever 39*a* of the governor 39, and the drive position of the lever 39*a* is detected by a position sensor 41. The detection signal of the position sensor 41 is sent to the controller 33 as a feedback position signal during the drive control of the motor 40.

A throttle dial 42 sets the target rotational speed of the engine 1, and a throttle signal corresponding to the target rotational speed εTH is sent to the controller 33. A monitor panel 43, moreover, selects and designates the work mode M effected by the hydraulic shovel, i.e., a "heavy excavation" mode M1, an "excavation" mode M2, an "adjustment" mode M3, or a "micro operation" mode M4, and a signal indicating the selected work mode M1, M2, M3, or M4 is sent to the controller 33.

A pump pressure sensor 44 is disposed in the pipe line 14, which detects the pressure of the pressure oil within the pipe line 14, i.e., the discharge pressure oil Pp of the oil pressure pump 2. The detected value Pp is then applied to the controller 33.

Operation amount sensors 45 and 46 for detecting stroke operation amounts (hereafter referred to as operation amounts) S1 and S2 are provided to the operation valves 7 and 8, respectively, and the detected values S1 and S2 are sent to the controller 33.

Figure 7A:
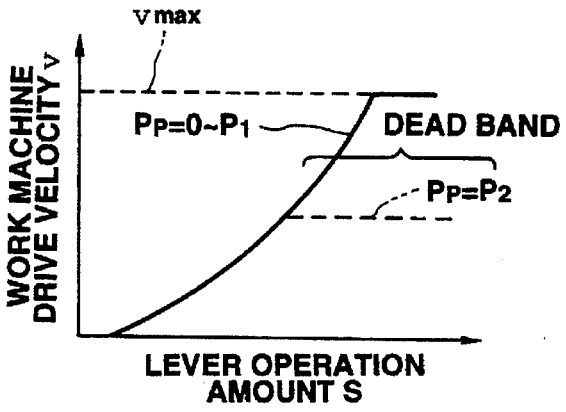
FIGS. 7(*a*) to 7(*c*) are graphs for explaining conventional techniques relating to differential pressure control.
Figure 7B:
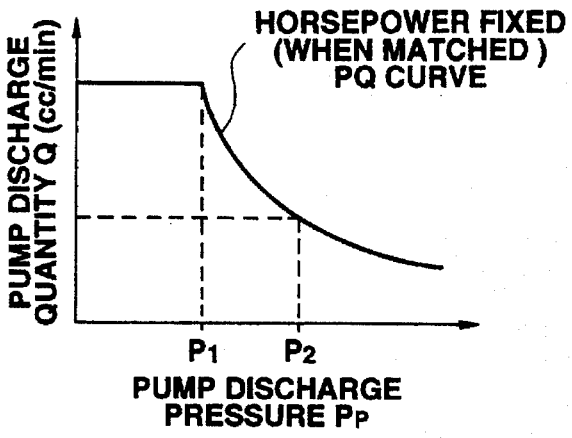
Figure 7C:
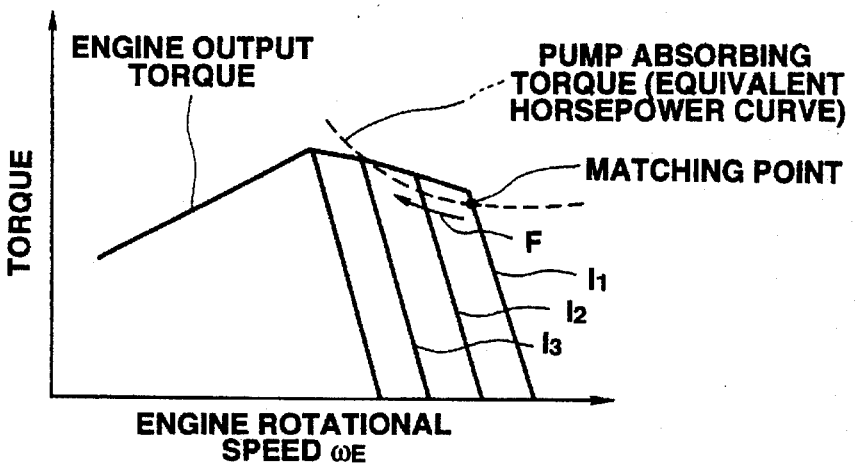

The controller 33 outputs a drive control signal to the motor 40 based on the various signals that have been input, and thereby controls the output torque of the engine 1. Specifically, as shown in FIG. 7(*c*), a drive control signal is sent to the motor 40 so that regulation lines 11, 12, 13, and so on corresponding to the input target rotational speed εTH and the current engine rotational speed εE detected by the engine rotation sensor 32 are established, and the fuel control lever 39*a* is operated.

Meanwhile, the controller 33 effects processing such as that described below based on the various input signals, and outputs the control signal obtained as a result to the solenoid 36*a* of the control valve 36 to control the swash angle of the swash plate 2*a* of the hydraulic pump 2, i.e., the discharge amount D (cc/rew) of the hydraulic pump 2, via the control valve 37 and the regulator 12. In this case, the controller 33 outputs a control signal that sets the absorbing horsepower of the hydraulic pump 2 to a fixed value. Specifically, the hydraulic pump 2 outputs to the control valve 36 a control signal such that a fixed horsepower corresponding to the input work mode M1 . . . is obtained, and thereby controls the swash plate 2*a* of the hydraulic pump 2 via the control valve 37. In this way, the matching point moves to the point of optimal efficiency according to the current load conditions (see FIG. 7(*c*)).

Meanwhile, the controller 33 outputs a control signal so that the differential pressure ΔPLS set in the manner described below is obtained. Specifically, the controller 33 effects both the control of the pump absorbing horsepower and the control of the differential pressure by means of the same control signal; in this case, the control pressure Pc applied to the pilot port 37*a* of the control valve 37 varies according to the control signal sent to the solenoid 36*a* of the control valve 36, whereby the differential pressure ΔPLS is varied. With this embodiment, this differential pressure ΔPLS is varied according to various controls, as described below, to improve the operability of the operation levers (not shown in the figures) of the operation valves 7 and 8. The variable control of this differential pressure ΔPLS is described in detail below.

First Control

This first control aims to improve the operability by varying the differential pressure ΔPLS depending on the load currently on the work machine actuator.

Specifically, in the system shown in FIG. 1, the output torque of the engine 1 and the absorbing torque of the hydraulic pump 2 are generally matched at the matching point, as shown in FIG. 7(*c*), and the discharge quantity Q (cc/min) of the pump 2 is controlled according to a PQ curve such as that shown in FIG. 7(*b*), so that the absorbing torque at this time can be obtained. In this way, the engine failure of the engine 1 is prevented by means of equivalent horsepower control. As shown in FIG. 7(*b*), however, an increase in the load PLS on the work machine actuators 3 and 4, i.e., in the discharge pressure Pp of the hydraulic pump 2, is accompanied by a decrease in the pump discharge quantity Q. For this reason, when the load is considerable, the engine failure prevention function acts as a limiter on the pump discharge amount (volume) (cc/rev).

FIG. 7(*a*) shows the general relationship between the operation amounts S (S1, S2) of the operation levers and the drive velocities v (v1, v2) of the work machine actuators 3 and 4; when the work machine actuator with a considerable load is driven and the discharge pressure Pp increases from P1 to P2 (see FIG. 7(*b*)), this is accompanied by the control of the discharge amount, as shown by the dotted line, and thus by the control of the drive velocity, which results in the enlargement of the so-called dead band (dead stroke).

With this embodiment, therefore, a control signal is output to the control valve 36 so that an increase in the discharge pressure Pp detected by the pump pressure sensor 44, i.e., in the load PLS of the work machine actuators 3 and 4, is accompanied by a decrease in the differential pressure ΔPLS.

Figure 2:
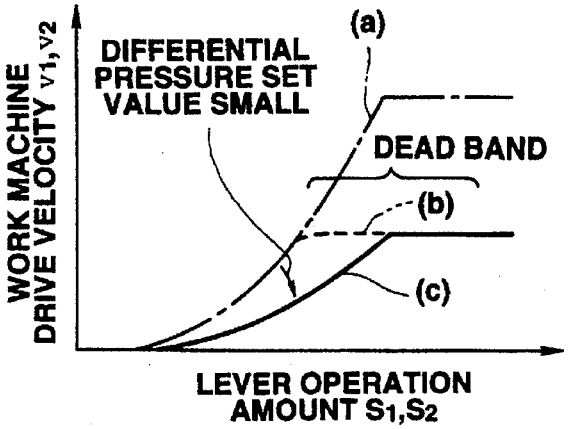
FIG. 2 is a graph which depicts the relationship between operation amounts of operation levers and drive velocities of work machine actuators in the embodiment.

Specifically, FIG. 2 depicts the relationship between the work machine actuator drive velocities v1 and v2 and the operation amounts S1 and S2 pertaining to the "first control"; because of the fact that an increase in the load Pp is accompanied by a decrease in the differential pressure ΔPLS, even when the load Pp is considerable, there is no shift to the characteristics (b) with a considerable dead band, but there is a shift to the characteristics (c) with a low gradient, and the dead band is small, as is the case with the characteristics (a) where the load Pp is small; this allows good lever operability to be maintained.

Second Control

With the first control described above, the differential pressure ΔPLS is varied according to the pump discharge pressure Pp; however, when the differential pressure ΔPLS is varied in a one-to-one correspondence by means of the pump discharge pressure Pp alone, load variations are readily brought about in the work machine actuator micro velocity region in which the operation amounts are low, and this load variation results in a variation in the velocities v1 and v2, which causes the operator some discomfort. With this embodiment, therefore, a control signal is output to the control valve 36 so that increases in the operation amounts S1 and S2 detected by the operation amount sensors 45 and 46, respectively, are accompanied by a decrease in the differential pressure ΔPLS, with the differential pressure determined by the pump discharge pressure Pp being taken as the minimum value; the aforementioned discomfort is thereby eliminated.

Figure 3:
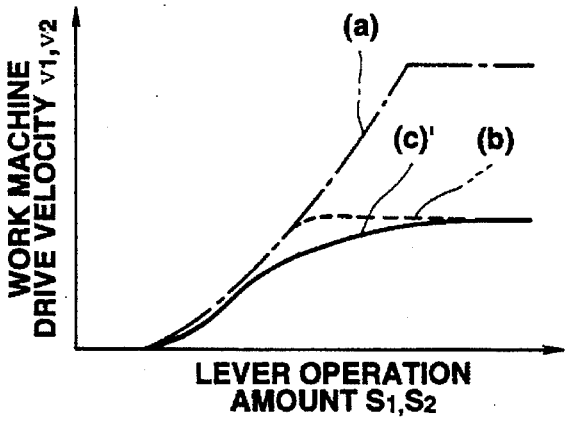
FIG. 3 is a graph which depicts the relationship between the operation amounts of the operation levers and the drive velocities of the work machine actuators in another embodiment.

The operating characteristic (c)' shown in FIG. 3 depicts the relationship between the work machine actuator drive velocities v1 and v2 and the operation amounts S1 and S2 which pertain to th "second control"; the larger the operation amounts S1 and S2, the smaller the differential pressure ΔPLS, and the drive velocities v1 and v2 are not suddenly limited with an increase in the operation amounts S1 and S2, as is shown by the characteristic (b), but the drive velocities v1 and v2 vary in such a way that they gradually approach the limiting values of the drive velocities v1 and v2 as the operation amounts S1 and S2 rise. In this case, when the operation amounts S1 and S2 of the work machine actuators are small, the differential pressure ΔPLS is large, and when, for example, the load is high, the characteristics are virtually unchanged from the characteristics (a) for a low load. In short, in the micro velocity region, the differential pressure is virtually unchanged by variations in the load, and it is possible to obtain favorable operability in which no discomfort is felt due to variations in the drive velocities v1 and v2. Ultimately, an increase in the operation amounts S1 and S2 is accompanied by a decrease in the differential pressure ΔPLS (the gradient becomes small due to the characteristic), until finally the differential pressure (minimum value) set by the pump discharge pressure is reached, and a dead stroke condition results.

The differential pressure ΔPLS is furthermore varied depending on the larger of the operation amounts S1 and S2 of the operation valves 7 and 8. The operation amounts S1 and S2, moreover, indicate the aperture areas A1 and A2 of the operation valves, and may thus be used to detect this.

Third Control

Figure 4:
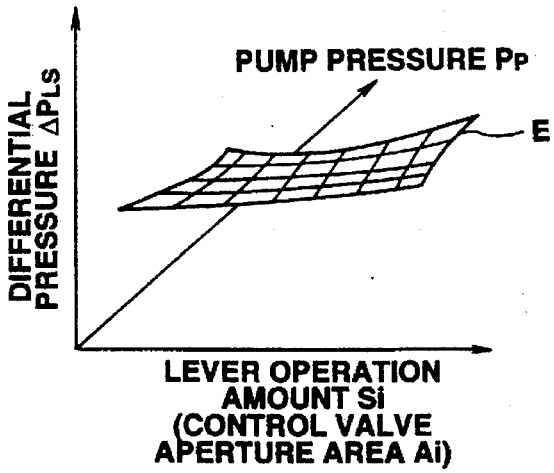
FIG. 4 is a three-dimensional diagram which depicts the contents stored in the controller of FIG. 1.

With the above-described first and second controls, the differential pressure ΔPLS is varied according to the pump discharge pressure Pp or the operation amounts S1 or S2 (whichever is the larger) so as to obtain the desired operating characteristics in a one-to-one correspondence; with a hydraulic shovel equipped with a plurality of work machines, however, required operating characteristics are different depending on which of the work machines is driven. With this third control, therefore, the direction in which a work machine is driven is detected by work sensors 45 and 46, operating characteristics are selected according to this detected work machine (boom, arm, or the like), and control is effected so as to obtain these selected operating characteristics, whereby the characteristics described above are satisfied. In this case, each control characteristic is stored in advance in a memory (not shown in the figure) in the controller 33, as shown in FIG. 4, as a three-dimensional map which depicts the relationship among the differential pressure ΔPLS, the pump discharge pressure Pp, and the lever operation amount Si (or the aperture area Ai of the operation valve) for each type of driven work machine i. Furthermore, the shape of the three-dimensional map E of FIG. 4 in practice differs for each work machine drive state, and FIG. 4 is nothing more than a simple example.

Figures 5A, 5B, 5C:
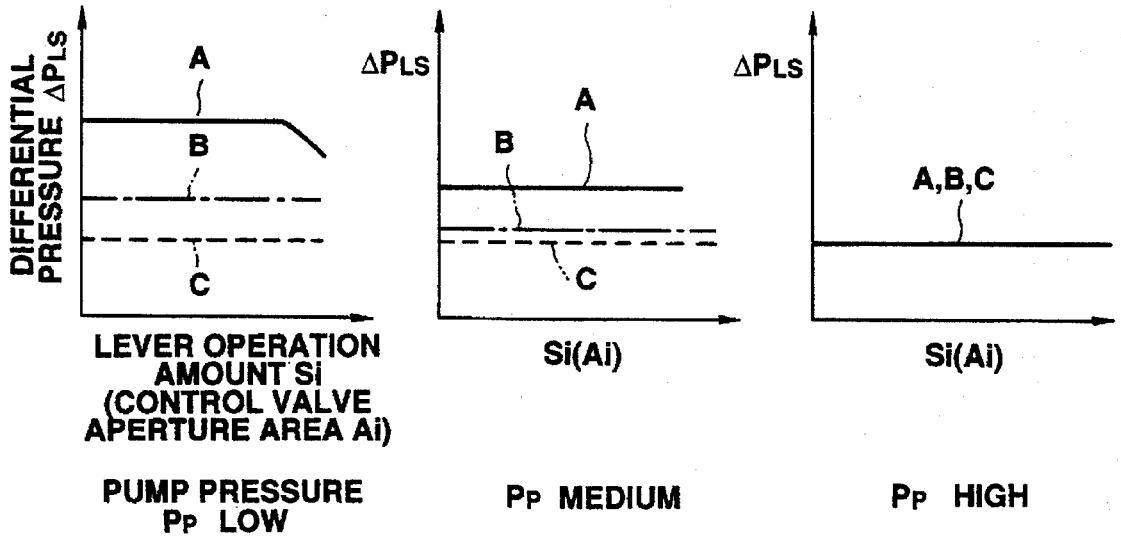
FIGS. 5(*a*) to 5(*c*) are two-dimensional diagrams depicting the contents of FIG. 4, and are diagrams that are used for explaining the manner in which the relationship among the operation amounts of the levers, the pump discharge pressure, and the differential pressure varies depending on the drive states of the work machines.

FIGS. 5(*a*) to 5(*c*) are two-dimensional representations of the three-dimensional map E shown in FIG. 4 that have been separated into cases in which the load Pp is low (FIG. 5(*a*)), the load Pp is of medium value (FIG. 5(*b*)), and the load Pp is high (FIG. 5(*c*)) and that show the drive states of the work machines, i.e., boom elevation (dotted line C), adjustment mode M3 arm excavation (dot-dash-dot line B), and other cases (solid line A).

As is clear from these figures, when the work machine drive state has been detected as being "boom elevation," the differential pressure ΔPLS is fixed, regardless of the load Pp detected value. This is due to the fact that since the load is extremely high during boom elevation, there are no problems from the standpoint of operability if the operating characteristics are determined by means of the work machine drive state alone, without regard to the load Pp detected value.

The operating characteristics (differential pressure) that should be selected may also be varied depending on the size of the absorbing torque of the hydraulic pump.

Figures 6A, 6B, 6C:
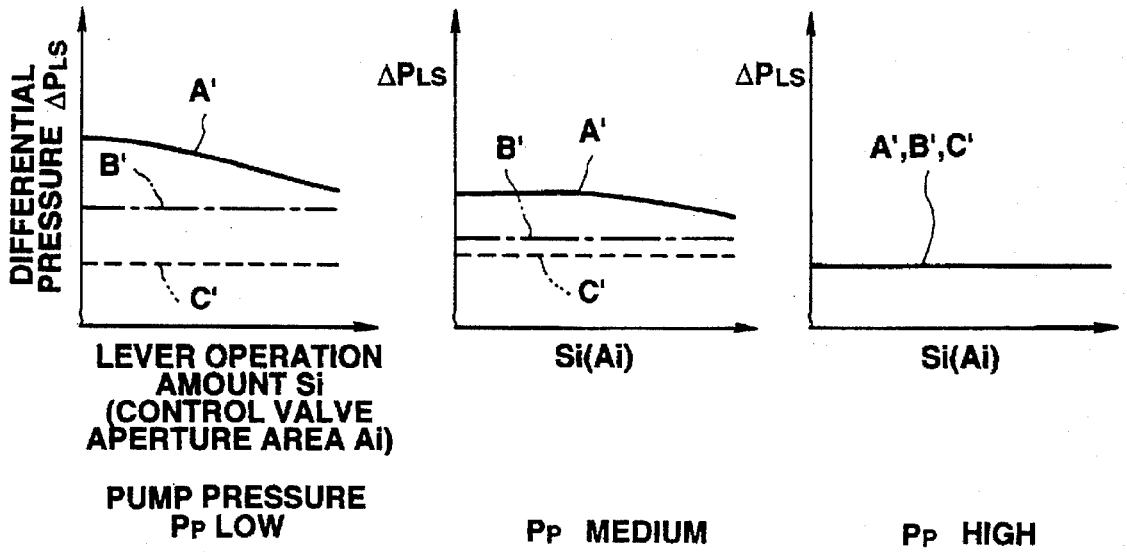
FIGS. 6(*a*) to 6(*c*) are diagrams which depict the relationships corresponding to FIGS. 5(*a*) to 5(*c*), respectively, when the hydraulic pump absorbing torque is low.

For example, when it has been made clear by the controller 33 that the absorbing torque of the hydraulic pump 2 has been set low, the A, B, and C characteristics shown in FIGS. 5(*a*) to FIG. 5(*c*) become the characteristics A', B', and C' shown in FIGS. 6(*a*) to 6(*c*). In this case, the reason that characteristic A' in FIG. 6(*a*) shows a decreasing differential pressure ΔPLS as the operation amount Si of the lever increases is that full lever operation is dependent on the power restrictions of the engine 1.

Even in the same work mode, when the work machine actuator for excavation work, such as the boom, is driven, and a work machine actuator for travel is driven, as work machine actuators, the operating characteristics required by each of the work machine actuators are different, and it is sometimes inconvenient to determine the operating characteristics based on a one-to-one correspondence with the work mode. Specifically, in operation in "excavation mode" M2 as well, as far as the drive velocity of the actuators for the boom, arm, and the like are concerned, although the aim is to effect drive at an ordinary drive velocity corresponding to "excavation mode," in the movements during the excavation work, because of the irregular shape of the earth's surface, for the sake of safety there is sometimes the contradictory requirement that the speed difference between ascending and descending slope should be made small, and the drive velocity of the actuator for travel should be made low, i.e., drive should be effected at a drive velocity corresponding to the "micro operation mode" M4.

In this case, when the excavation mode M2 is selected as the current work mode, a determination of which work machine actuator is currently being driven is made based on the detected values of the operation amount sensors 45 and 46; if travel is currently under way, operating characteristics with a low gradient and a low drive velocity (corresponding to the micro operation mode M4) similar to the characteristics (c) of FIG. 2 are selected to effect micro operation. On the other hand, when it has been determined that the boom or the like is currently being driven and that excavation is under way, operating characteristics such as those shown by characteristics (a) of FIG. 2, for which the slope is greater and the drive velocity is higher, and which correspond to the currently selected "excavation mode" M2, are selected. When it has been determined that the actuator for excavation and the actuator for travel are being driven simultaneously as work machine actuators, moreover, for the sake of safety operating characteristics such as those shown in the characteristics (c) of FIG. 2, for which the drive velocity becomes low, are selected.

A generalization of the third control goes as follows: a function G that has as variables the pump discharge pressure Pp and the operation amounts S1 to Sn (1 to n indicate various work machines) is first determined, and this is used to determine the differential pressure ΔPLS.

$$\Delta PLS = G(Pp,\ S1 \text{ to } Sn) \tag{2}$$

In this case, the map E of FIG. 4 shows the function G in a three-dimensional manner.

As shown by formula (3) below, moreover, the differential pressure ΔPLS that is determined by means of this function G may be bound by the restriction that the maximum differential pressure $\Delta PLS_{max}$ set in advance at a time of low load must not be exceeded.

$$\Delta PLS = \min(G(Pp,\ S1 \text{ to } Sn),\ \Delta PLS_{max}) \tag{3}$$

This maximum differential pressure $\Delta PLS_{max}$ is the differential pressure that determines the cycle time; when it is low the cycle time is delayed. For example, it is possible to make the cycle time correspond to the work mode by varying the maximum differential pressure $\Delta PLS_{max}$ depending on the work mode.

In the embodiment, moreover, although the differential pressure is varied based on the discharge pressure Pp of the hydraulic pump 2, it is also possible to vary the differential pressure based on the load of the work machine, and it is of course also possible to vary the differential pressure based on the load PLS of the work machine.

It is of course also possible to suitably combine the first through third controls described above with conventional techniques relating to differential pressure control (e.g., Japanese Laid-Open Patent Applications 2-76904 and 2-164941). In this case, even when, for example, the differential pressure is varied based on the load Pp so that the characteristics (c) shown in FIG. 2 are obtained, it is possible to consider varying the amount of this change depending on which work mode (M1 . . . ) has been selected by the monitor panel 43.

As described above, this embodiment involves varying the differential pressure ΔPLS according to, for example, the load Pp on the work machine actuator, and thus makes it possible to obtain optimal operability suited to the current working conditions and to dramatically improve working efficiency over that achieved in the past.

Fourth Control

With this fourth control, the differential pressure ΔPLS is varied depending on the engine rotational speed and the load currently on the work machine actuator to effect control that does not sacrifice lever operability even in the case of a pressure oil leak described above.

Generally, the effects of a pressure oil leak on the operating characteristics are said to be proportional to the ratio qL/Q of the leakage quantity qL in the hydraulic pump 2 hydraulic oil pipe line to the discharge quantity Q (cc/min). When this ratio qL/Q becomes high, the practical volume efficiency of the hydraulic pump 2 is degraded, the actual velocity of the work machine actuator falls, and the operation lever operating characteristics vary from the desired operating characteristics in the direction of decreasing differential pressure. Making the ratio qL/Q low therefore makes it possible to maintain the desired operating characteristics, and thus makes it possible to complete the operation without sacrificing lever operability.

Here, the pump discharge quantity Q is defined by $$Q = D \cdot \epsilon E \tag{4}$$

and is proportional to the engine rotational speed εE. On the other hand, the leakage quantity qL itself is known to be proportional to the loads on the work machine actuators 7 and 8, i.e., to the discharge pressure Pp of the hydraulic pump 2. Consequently, the ratio qL/Q is expressed by $$qL/Q = Pp/\epsilon E \tag{5}$$

and since the ratio qL/Q ultimately increases as the hydraulic pump discharge pressure Pp increases, in order to prevent a consequent decrease in differential pressure, correction is made in the direction of increasing the differential pressure as the pressure Pp increases, which makes it possible to maintain the desired operating characteristics; since the ratio qL/Q increases as the engine rotational speed εE decreases, moreover, in order to prevent the consequent decrease in differential pressure, correction is made in the direction of increasing the differential pressure as the rotational speed εE decreases, which makes it possible to maintain the desired operating characteristics.

Figures 8A, 8B, 8C:
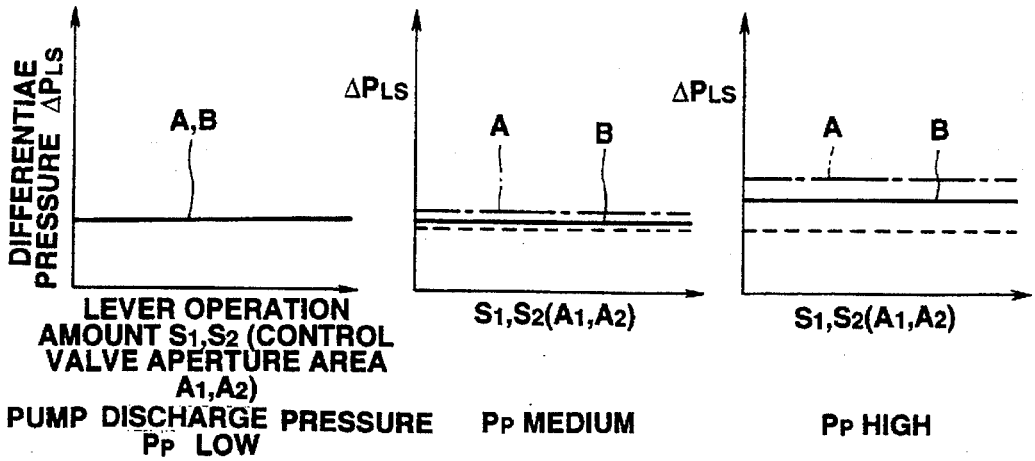
FIGS. 8(*a*) to 8(*c*) are graphs depicting the manner in which the differential pressure varies depending on the engine rotational speed and pump discharge pressure.

FIGS. 8(*a*) to 8(*c*) show, for the implementation of this first control, the relationship between the operation amounts S1 and S2 (or the operation valve aperture areas S1 and S2) of the operation levers and the differential pressure ΔPLS, separated into cases in which the pump discharge pressure Pp is low (FIG. 8(*a*)), cases in which the pump discharge pressure Pp is of medium value (FIG. 8(*b*)), and cases in which the pump discharge pressure Pp is high (FIG. 8(*c*)), for cases in which the engine rotational speed εE is low (dot-dash-dot line A) and cases in which the engine rotational speed εE is high (solid line B).

As is clear from FIGS. 8(*a*) to 8(*c*), as the pump discharge pressure Pp increases from FIG. 8(*a*) to FIG. 8(*b*), and then to FIG. 8(*c*), the differential pressure ΔPLS increases, and as the engine rotational speed εE decreases from B to A, the differential pressure ΔPLS is set at a high level.

The contents of FIGS. 8(*a*) to 8(*c*) are stored in advance in a memory, not shown in the figures, in the controller 33, the differential pressure ΔPLS corresponding to the detected values of FIG. 8(*a*), FIG. 8(*b*), and FIG. 8(*c*) is fetched based on the engine rotational speedεE detected by the rotation sensor 32 and the pump discharge pressure Pp detected by the pump pressure sensor 44, and a control signal is output to the control valve 36 so that this differential pressure ΔPLS is obtained. As a result, the lever operating characteristics are not varied even in the event of a pressure oil leak, and the desired operating characteristics are maintained.

With this fourth control, furthermore, although the differential pressure is varied based on the discharge pressure Pp of the hydraulic pump 2, it is also possible to vary the differential pressure based on the load on the work machine, and it is of course also possible to vary the differential pressure based on the load PLS of the work machine.

Fifth Control

With this fifth control, when the operation valve is in a neutral position, the differential pressure ΔPLS is lowered below the set differential pressure for positions other than neutral, and is varied according to the engine rotational speed; this is effective at preventing the generation of such problems as "jumping" at high engine rotational speeds and "dead time increase" at low engine rotational speed, which have been described above, and thereby improves operability when lever operation is begun.

Figure 9A:
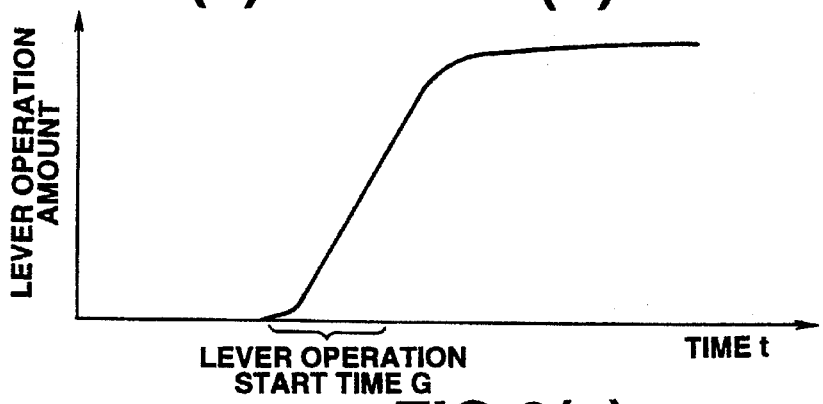
FIGS. 9(*a*) to 9(*c*) are graphs depicting the manner in which the operation lever operation amounts, the work machine actuator drive velocities, and the differential pressure, respectively, vary over time, and are graphs used for explaining the effects of the embodiment in a comparison with conventional techniques.
Figure 9B:
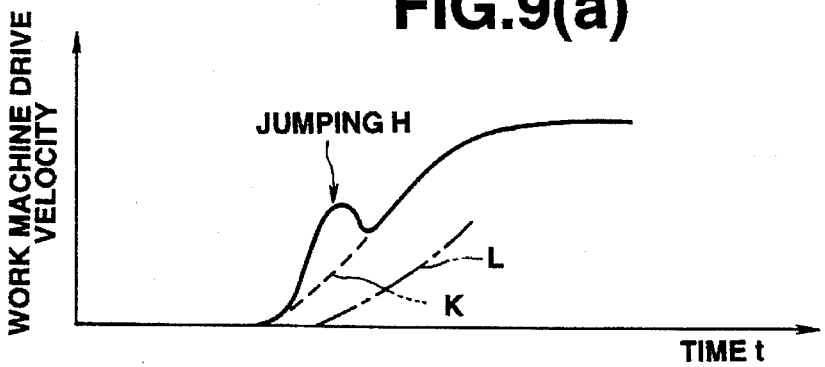
Figure 9C:
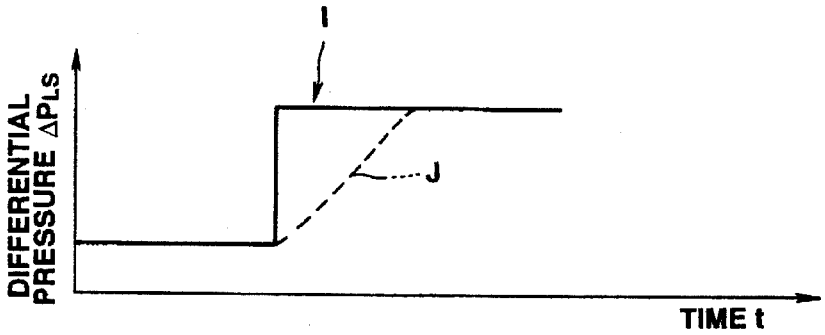

As described above, Japanese Patent Application Laid-Open No. 2-164941 provides an improvement in operability by effecting control in such a way that the differential pressure PLS is decreased with a decrease in engine rotational speed; when all of the operation valves are operated in a neutral position N, however, and the aforementioned control is effected in this condition, then the differential pressure ΔPLS becomes considerable when operation lever operation is begun, as shown by G in FIG. 9(*a*), and at high engine rotational speeds, as shown by H in FIG. 9(*b*), and this in turn results in the "jumping" phenomenon, in which the work machine actuator drive velocity increases suddenly. This is caused by the fact that there is no difference between the differential pressure set in the neutral position N and the differential pressure set when control is effected for a position other than the neutral position N, and is also caused by a sudden increase in the differential pressure ΔPLS when lever operation is begun, as shown by I in FIG. 9(*c*).

The differential pressure when the operation levers, i.e., the operation valves 7 and 8, are in the neutral position N is ΔPLSn, and the differential pressure when the operation levers are in an operated state other than the neutral position N is ΔPLSa; when the neutral position differential pressure ΔPLSn is lower than the control differential pressure ΔPLSa, as in $$\Delta PLSn > \Delta PLSa \quad (6)$$

then the differential pressure increases along a transitional, gentle slope such as that shown by the dotted line J in FIG. 9(*c*), and the "jumping" phenomenon is eliminated, as shown by the dotted line K in FIG. 9(*b*).

Figure 10:
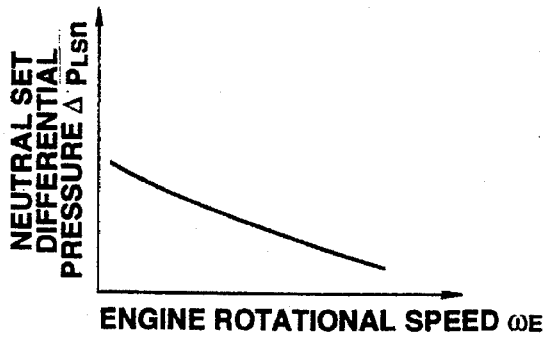
FIG. 10 is a graph depicting the relationship between the engine rotational speed and differential pressure set value when the operation levers are in a neutral position.

At low engine rotational speeds, on the other hand, with the conventional method the differential pressure ΔPLS becomes low both at the neutral position N and at low engine rotational speeds, there is no increase in work machine actuator drive velocity when lever operation is begun, as shown by the dot-dash-dot line L in FIG. 9(*b*), and an increase in dead time and dead band occurs. Consequently, in the neutral position N, as opposed to the other positions, the differential pressure ΔPLSn is increased in accordance with a decrease in the engine rotational speed εE, as shown in FIG. 10, and it is thereby possible to remove such inconveniences as the increase in dead time. As shown in this FIG. 10, moreover, the differential pressure ΔPLSn is varied so that it decreases with an increase in engine rotational speed εE, so that it is possible to effectively prevent the "jumping" phenomenon that becomes marked with an increase in engine rotational speed.

Ultimately, as shown by Formula (6) and FIG. 10, when either of the operation valves 7 and 8 is in the neutral position, the differential pressure ΔPLSn is set so that it is smaller than the differential pressure ΔPLSa when either of the operation valves 7 and 8 is operated, and so that it decreases as the engine rotational speed εE increases; both of the aforementioned inconveniences are thereby eliminated, and operability when lever operation is begun can thus be improved.

The contents of Formula (6) and FIG. 10 are stored in advance in a memory, not shown in the figure, in the controller 33, and a check is made to detect if either of the operation valves 7 and 8 are in the neutral position N, and when this neutral position N is detected, then the differential pressure ΔPLSn corresponding to the output εE of the rotation sensor 32 is fetched from the memory, and a control signal is output to the control valve 36 so that this differential pressure ΔPLSn is obtained. As a result, the "jumping" phenomenon and the like are eliminated when lever operation is begun, and an operability superior to that achieved in the past is realized.

This fifth control is thus clearly suitable not only for cases in which a conventional technique for reducing the differential pressure according to a decrease in engine rotational speed is used, but also for cases in which the differential pressure is set at the time of lever operation without consideration of engine rotational speed.

Sixth Control

With this sixth control, the rotational speed εE of the engine i and the discharge pressure Pp of the hydraulic pump 2, i.e., the load pressure PLS of the work machine actuators 3 and 4 and the operation amounts S1 and S2 of the operation valves 7 and 8, are detected, the absorbing torque τ of the hydraulic pump 2 is set by means of equivalent horsepower control based on the detected rotational speed εE and the target rotational speed εTH of the engine 1, and the differential pressure ΔPLS is varied in accordance with these detected values and the torque set value τ, whereby control limiting the absorbing torque of the hydraulic pump 2 is effected, inconveniences such as engine failure are prevented, and good lever operability is obtained.

In general, the relationship shown in Formula (7) below holds among the differential pressure ΔPLS, the absorbing torque τ of the hydraulic pump 2, the sum total A of the aperture areas of the operation valves 7 and 8, the discharge pressure Pp of the hydraulic pump 2, and the rotational speed εE of the engine 1.

$$\sqrt{(\Delta PLS)}=\epsilon E\cdot\tau/(k\cdot Pp\cdot A) \quad (7)$$

Here, A=A1 to An (where 1 to n indicate operation valves; A1+A2 in this embodiment). Formula (7) is obtained as described below. Specifically, the relationship Q=D·εE holds between the capacity D and the discharge quantity Q (cc/min) of the hydraulic pump 2, and the absorbing torque τ of the pump 2 is expressed by τ=D·Pp=τ(τE·εTH). Thus, Q=C·A·√(ΔPLS) holds according to Formula (1). Formula (7) is thus obtained by eliminating Q and D from these formulas. Furthermore, since the pump discharge pressure Pp and the actuator load pressure PLS are essentially the same, PLS can be used in place of Pp in Formula (7).

The maximum value for the discharge quantity Q of the hydraulic pump 2 is determined when the operation valves 7 and 8 are operated up to the maximum operation amounts at the maximum rotational speed of the engine 1. The differential pressure ΔPLS obtained through Formula (7) by first determining this discharge quantity Q maximum value and by taking the corresponding maximum differential pressure as $\Delta PLS_{max}$ must not exceed the maximum differential pressure $\Delta PLS_{max}$. Ultimately, the differential pressure ΔPLS is determined by means of Formula (8).

$$\Delta PLS=\min(\{\epsilon E\cdot\tau/(k\cdot Pp\cdot A\}2,\ \Delta PLS_{max}) \quad (8)$$

The εE, Pp, and A of εE·τ/(k·Pp·A) in Formula (8) can be obtained from the detected values of the corresponding sensors, and τ is obtained by setting the absorbing torque τ of the hydraulic pump 2 according to equivalent horsepower control based on the detected rotational speed εE and the target rotational speed εTH of the engine 1. The aperture area sum total A may be obtained as the sum of the outputs S1 and S2 of the operation amount sensors 45 and 46, or may be obtained as the larger of the outputs S1 and S2 of the operation amount sensors 45 and 46.

As described above, because the set horsepower varies (the equivalent horsepower curve shown in FIG. 7(*c*) differs) depending on the work mode (M1 . . . ), and the absorbing torque τ set thereby thus also varies, it may be so arranged that the function εE·τ/(k·Pp·A) on the right side of Formula (7) is prepared for each work mode (M1 . . . ) as a function in which the engine rotational speed εE . . . are variables, the function corresponding to the selected work mode (M1 . . . ) is selected, and the differential pressure ΔPLS is calculated based on this selected function.

Furthermore, it is also possible to prepare the function εE·τ/(k·Pp·A) for each drive state of the work machine actuators 3 and 4, according to which work machine is being driven in which direction. Since the absorbing torque to be set varies depending on the drive state, it is necessary, for example, in the case of boom elevation, to set the absorbing torque τ high because the load is high, and in the case of bucket operation, the absorbing torque may be set low because the load is comparatively low. Which work machine is being driven in which direction can moreover be detected based on the outputs of the operation amount detection sensors 45 and 46.

Since the maximum differential pressure $\Delta PLS_{max}$ also varies depending on the drive state of the work machine actuators 7 and 8 and on the selected work mode (M1 . . . ), it can also be determined based on these.

With this sixth control, therefore, the aforementioned function is selected based on the selected work mode (M1 . . . ), the type of currently driven actuators 3 and 4 detected by the operation amount sensors 45 and 46, and the drive direction thereof, and the substitution of the engine rotational speed εE . . . into this selected function allows the differential pressure ΔPLS of Formula (7) to be determined. Meanwhile, the differential pressure maximum value $\Delta PLS_{max}$ is determined based on the selected work mode (M1 . . . ), the type of currently driven actuators 3 and 4 detected by the operation amount sensors 45 and 46, and the drive direction thereof, the smaller differential pressure ΔPLS is determined by Formula (8), and a control signal is output to the control valve 36 so that this determined differential pressure ΔPLS is obtained.

The operating characteristics (a) and (c) of FIG. 2 express the relationship between the operation amounts S1 and S2 and the work machine actuator drive velocities v1 and v2 for cases in which the load is low and cases in which the load is high, respectively, according to this sixth control; since the differential pressure ΔPLS decreases as the load Pp increases according to Formula (7), there is no shift from the characteristics (a) to the characteristics (b), in which there is a considerable dead band, even when the load Pp is high, but there is a shift towards the characteristics (c), in which there is a low gradient, so that the dead band is kept low, as is the case with characteristics (a), in which the load Pp is low, and good operability is thus maintained. Moreover, since the equivalent horsepower control of the absorbing torque of the hydraulic pump 2 is effected at the same time, no inconveniences such as engine failure occur. The characteristics (b) shown by the dotted line in FIG. 2, furthermore, depict cases in which control is not effected based on Formula (7), from which it is seen that the dead band is enlarged and the operability is degraded due to a torque limitation encountered when the load is high.

Seventh Control

With the sixth control, since the differential pressure ΔPLS is varied according to Formula (7), good operability that is suitable for the load currently on the work machine can be obtained; with this seventh control, however, the aim is to realize more precise control by correcting the load Pp of Formula (7).

Figure 11A:
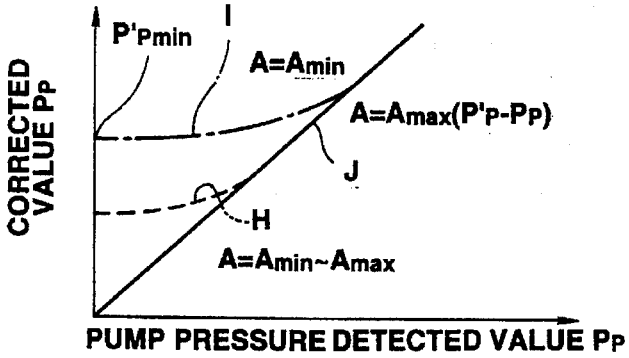
FIGS. 11(*a*) to 11(*c*) are graphs used for explaining an embodiment that corrects the pump discharge pressure according to the sum total of the aperture areas of the control valves.
Figure 11B:
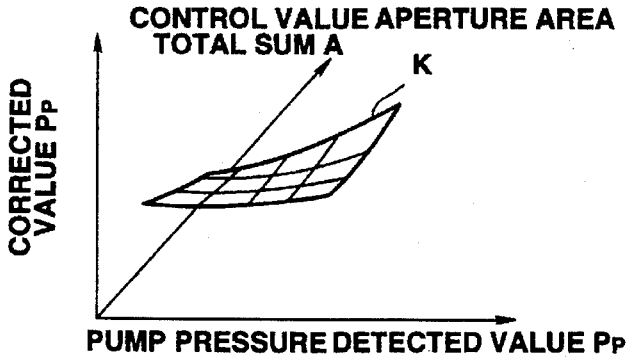
Figure 11C:
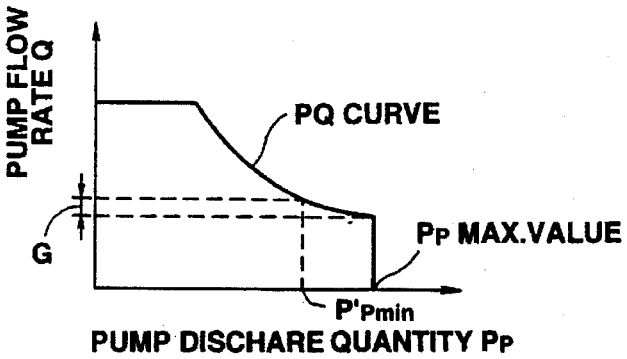

FIG. 11(*c*) shows the relationship between the pump discharge pressure Pp and the pump discharge quantity Q; since the PQ curve is generally approached as the sum total A of the aperture areas decreases, i.e., as the operation amounts S1 and S2 of the operation levers decrease, variations in the actual pressure Pp result, as shown by G, in variations in the quantity Q, and thus in variations in the differential pressure, which has an adverse effect on operability.

Ultimately, as shown in FIG. 11(*a*), this seventh control allows the pump discharge pressure detected value Pp to be corrected so that the discharge pressure Pp' gradually increases, as shown by the dot-dash-dot line I and the dotted line H, .as the aperture area sum total A decreases. In FIG. 11(*a*), the solid line J depicts the relationship between the detected value Pp and the corrected value Pp' when the aperture area sum total A is at its maximum value $A_{max}$; when the aperture area sum total A is at its maximum, there is no degradation in operability, and the detected value Pp is thus not corrected. When the aperture area sum total A is higher than the minimum value $A_{min}$ and lower than the maximum value $A_{max}$, correction is performed, as indicated by the dotted line H, and when the aperture area sum total A is at the maximum value $A_{max}$ then, as shown by the dot-dash-dot line I, the corrected value is made larger than in the case of the dotted line H, resulting in a degradation of operability.

The reason that the corrected value decreases as the detected value increases is that, since the variation width of the flow rate Q decreases as the pump pressure Pp increases, as is clear from FIG. 11(*c*), the variation in the differential pressure decreases, and not that much correction is required.

The contents of FIG. 11(*a*) may be expressed, as FIG. 11(*b*), in which the relationship among the pump pressure detected value Pp, the aperture area sum total A, and the corrected value Pp' is represented as a three-dimensional map K, and correction may be carried out according to this three-dimensional map K.

Accordingly, with this seventh control, the contents of FIG. 11(*a*) or FIG. 11(*b*) are stored in advance in the memory, not shown in the figures, in the controller 33. The corresponding corrected value Pp' in FIG. 11(*a*) or FIG. 11(*b*) may thus be fetched based on the detected value Pp of the pump pressure sensor 44 and the detected values S1 and S2 of the operation amount sensors 45 and 46. In this case, the aperture area sum total A may be determined from the sum total of the operation amounts S1 and S2, or may be determined to be the larger of the operation amounts S1 and S2.

The thus obtained corrected value Pp' is then used to correct Formula (8) to Formula (9) below.

$$\Delta PLS=\min(\{\epsilon E\cdot\tau/(k\cdot Pp'\cdot A)\}2,\ \Delta PLS_{max}) \quad (9)$$

A control signal for obtaining this corrected differential pressure ΔPLS is then output to the control valve 36. As a result, operability in the micro velocity region of the operation levers is further improved.

Eighth Control

With the sixth control, the differential pressure ΔPLS is varied according to Formula (7), and good operability that suits the load currently on the work machine can thus be obtained, but this eighth control allows precise control to be effected by correcting the absorbing torque τ in Formula (7).

Formula (7) is a formula for determining the differential pressure ΔPLS so that the absorbing torque τ on the PQ curve is not exceeded. Therefore, when the operation lever operation amounts are low in which horsepower limitation due to the PQ curve is not encountered, the engine output and the pump load are matched at a torque no more than the absorbing torque τ (maximum value) and thus a flow rate corresponding to the lever stroke can be fed. It is therefore managed to correct the torque τ in Formula (7) to τ' so that the absorbing torque will decrease as the operation amount detected values S1 and S2 decrease.

With this eighth control, therefore, a calculation formula or the like for determining the corrected value τ' so that the torque τ is decreased as the aperture area sum total detected value A decreases is stored in advance in the memory, not shown in the figures, in the controller 33. The corrected value τ' is thus calculated based on the contents of the memory and on the detected values S1 and S2 of the operation amount sensors 45 and 46. In this case, the aperture area sum total A may be determined from the sum total of the operation amounts S1 and S2, or it may be taken as the larger of the operation amounts S1 and S2.

The corrected torque τ' is thus used to correct Formula (8) to Formula (10), whereby the corrected differential pressure ΔPLS can be found.

$$\Delta PLS=(\{\epsilon E\cdot\tau'/(k\cdot Pp'\cdot A)\}2,\ \Delta PLS_{max}) \quad (10)$$

A control signal for obtaining this corrected differential pressure ΔPLS is thus output to the control valve 36, and operability in the micro velocity region is further improved.

As described above, according to this embodiment, the engine rotational speed, hydraulic pump discharge pressure, and operation valve operation amounts are each detected, the absorbing torque of the hydraulic pump is set, and the differential pressure ΔPLS is varied based on a specific relationship that is established among these detected values, the set torque, and the differential pressure ΔPLS; it is thus possible to realize optimal lever operability suitable for the present working conditions, and thus possible to remarkably improve the working efficiency.

This embodiment, furthermore, has been explained assuming cases in which, as shown in FIG. 7(*c*), the hydraulic pump 2 is subjected to equivalent horsepower control; however, this embodiment can of course also be applied to cases in which the hydraulic pump 2 is subjected to fixed torque control, as long as it is control that allows the engine output torque and the hydraulic pump absorbing torque to be matched.

An example of differential pressure ΔPLS control is described below.

Figure 12:
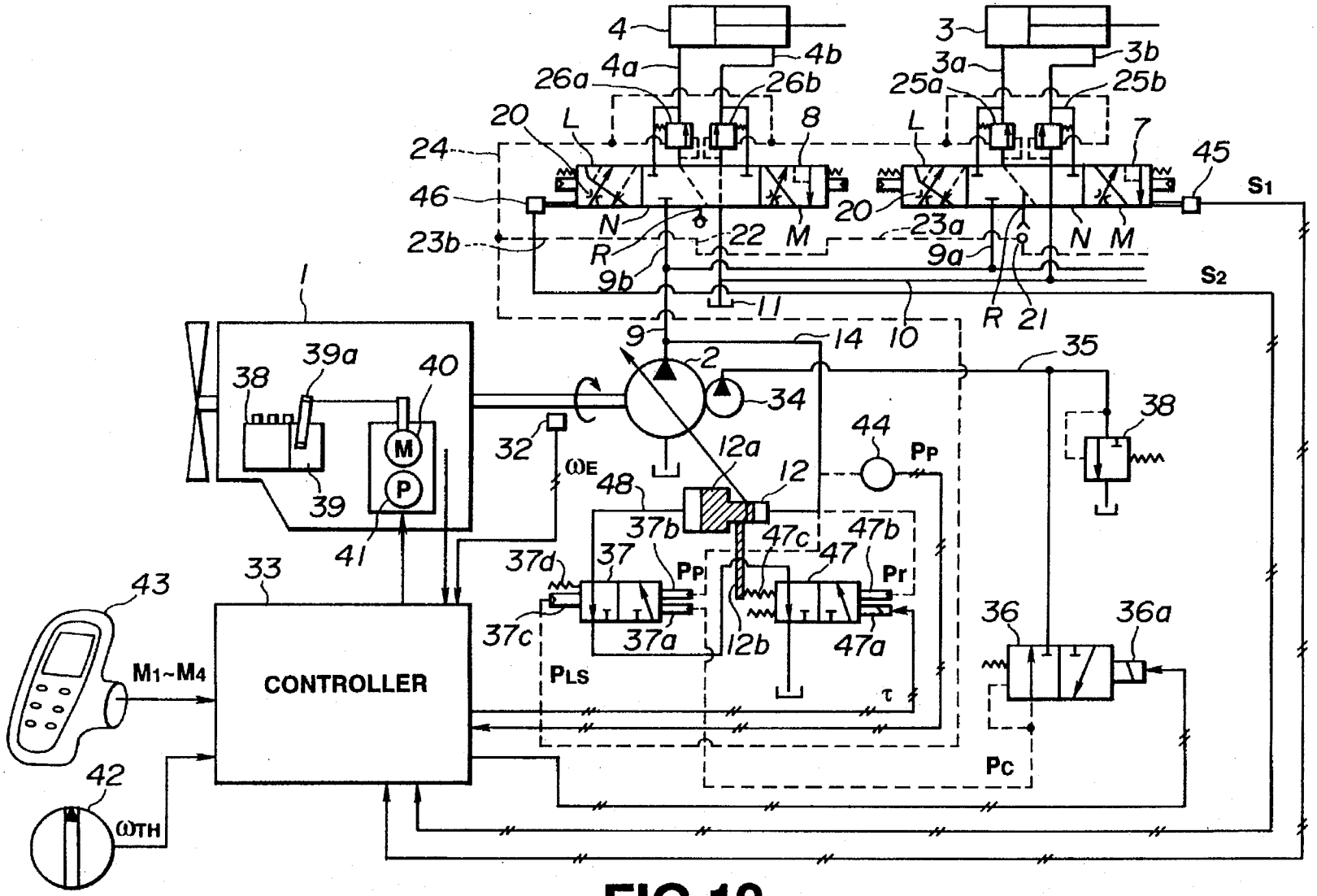
FIG. 12 is a circuit diagram depicting another example of the structure of a work machine hydraulic circuit.

With the ninth, tenth, and eleventh controls, described below, the structure depicted in FIG. 12 is used as the hydraulic circuit. The structure depicted in FIG. 12 differs from FIG. 1 in the following points.

Specifically, a pipe line 48 that connects the cylinder chamber on the large diameter side of the regulator 12 with the differential pressure control valve 37 communicates with a torque control valve 47 for controlling the absorbing torque of the hydraulic pump 2, and the swash angle of the swash plate 2*a* is controlled by means of the differential pressure control valve 37 and the torque control valve 47.

One end of the torque control valve 47 is connected via a spring 47*c* to a push member 12*b* that pushes a piston 12*a* of the regulator 12, and the pump pressure Pp in a pipe line 14 is applied as the pilot pressure to a pilot port 47*b* at the other end. An electronic solenoid 47*a* is positioned on the same side as this pilot port 47*b*, and a control signal from the controller 33 is sent to this solenoid 47*a*.

This torque control valve 47 controls the swash angle of the swash plate 2*a* so that the pump absorbing torque does not exceed the torque τ designated by the controller 33. Specifically, a control signal that designates the torque τ is output from the controller 33 to the solenoid 47*a* of the torque control valve 47, and the swash plate position input via the push member 47*c*, i.e., the valve position, is moved so that the torque τ designated by the pump capacity D and the discharge pressure Pp input via the pilot port 47*b* are not exceeded, and the swash plate 2*a* is thereby controlled.

Meanwhile, the controller 33 carries out calculation processing in the manner described below based on the various input signals, outputs the control signal obtained as a result to the solenoid 36*a* of the control valve 36 and to the electromagnetic solenoid 47*a* of the torque control valve 47, and thereby controls the swash angle of the swash plate 2*a* of the hydraulic pump 2, i.e., the discharge amount D (cc/rev) of the hydraulic pump 2, via the differential pressure control valve 37, the torque control valve 47, and the regulator 12.

In this case, the controller 33 outputs a control signal that sets the absorbing horsepower at a fixed value, as described below, to the torque control valve 47. Specifically, a control signal is output to the torque control valve 37 so that the absorbing horsepower of the hydraulic pump 2 becomes a fixed horsepower corresponding to the input work mode (M1 . . . ), and the swash plate 2*a* of the hydraulic pump 2 is thus controlled via the torque control valve 37. In this way, the matching point moves to the point of optimal efficiency for the present load conditions (see F in FIG. 7(*c*)).

Meanwhile, the controller 33 outputs a control signal to the control valve 36 so that the differential pressure ΔPLS set in the manner described below is obtained. Specifically, the controller 33 controls the pump absorbing horsepower as well as the differential pressure; here, the control pressure Pc applied to the pilot port 37*a* of the control valve 37 varies according to the control signal sent to the solenoid 36*a* of the control valve 36, and the differential pressure ΔPLS is thus varied. With this embodiment, this differential pressure ΔPLS is varied according to the various control manners, as described below, and this improves the operability of the operation levers, not shown in the figures, of the operation valves 7 and 8.

The variable control of the differential pressure ΔPLS used in the hydraulic circuit of FIG. 12 is described in detail below.

Ninth Control

With this ninth control, as with the sixth control, the rotational speed εE of the engine i and the discharge pressure Pp of the hydraulic pump 2, i.e., the load pressure PLS of the work machine actuators 3 and 4 and the operation amounts S1 and S2 of the operation valves 7 and 8, are each detected, the absorbing torque τ of the hydraulic pump 2 is set according to equivalent horsepower control based on the detected rotational speed εE and the target rotational speed εTH of the engine 1, and the differential pressure ΔPLS is varied according to these detected values and the torque set value τ, whereby control limiting the absorbing torque of the hydraulic pump 2 is effected, inconveniences such as engine failure are prevented, and good lever operability is obtained.

Generally, a relationship such as that given in Formula (7) below holds, as described above, among the differential pressure ΔPLS, the absorbing torque τ of the hydraulic pump 2, the aperture area sum total A of the operation valves 7 and 8, the discharge pressure Pp of the hydraulic pump 2, and the rotational speed εE of the engine 1.

$$\sqrt{(\Delta PLS)}=\epsilon E\cdot\tau/(k\cdot Pp\cdot A) \quad (7)$$

The maximum value for the discharge quantity Q of the hydraulic pump 2 is naturally determined when the operation valves 7 and 8 are operated up to the maximum operation amounts at the maximum rotational speed of the engine 1. The differential pressure ΔPLS obtained through Formula (7) by first determining this discharge quantity Q maximum value and by taking the corresponding maximum differential pressure as $\Delta PLS_{max}$ must not exceed the maximum differential pressure $\Delta PLS_{max}$. Ultimately, the differential pressure ΔPLS is determined by means of Formula (8).

$$\Delta PLS=\min(\{\epsilon E\cdot\tau/(k\cdot Pp\cdot A\}2,\ \Delta PLS_{max}) \quad (8)$$

The εE, Pp, and A of the function εE τ/(k Pp A) in Formula (8) can be obtained from the detected values of the corresponding sensors, and τ is obtained by setting the absorbing torque τ of the hydraulic pump 2 according to equivalent horsepower control based on the detected rotational speed εE and the target rotational speed εTH of the engine 1. The aperture area sum total A may be obtained as the sum of the outputs S1 and S2 of the operation amount sensors 45 and 46, or may be obtained as the larger of the outputs S1 and S2 of the operation amount sensors 45 and 46.

As described above, the set horsepower varies depending on the work mode (M1 . . . ) (the equivalent horsepower curve shown in FIG. 7(*c*) is different), and the absorbing torque τ set thereby thus also varies, so that the function εE·τ/(k·Pp·A) on the right side of Formula (7) is prepared for each work mode (M1 . . . ) as a function in which the engine rotational speed εE . . . are variables, the function corresponding to the selected work mode (M1 . . . ) is selected, and the differential pressure ΔPLS is calculated based on this selected function. Furthermore, the function εE·τ/(k·Pp·A) can also be prepared for each drive state of the work machine actuators 3 and 4, according to which work machine is being driven in which direction. Since the absorbing torque to be set varies depending on the drive state, it is necessary, for example, in the case of boom elevation, to set the absorbing torque τ high because the load is high, and in the case of bucket operation, the absorbing torque may be set low because the load is low. Which work machine is being driven in which direction can moreover be detected based on the outputs of the operation amount detection sensors 45 and 46.

Since the maximum differential pressure $\Delta PLS_{max}$ also varies depending on the drive state of the work machine actuators 7 and 8 and on the selected work mode (M1 . . . ), it can also be determined based on these.

With this ninth control, therefore, the aforementioned function is selected based on the selected work mode (M1 . . . ), the type of currently driven actuators 3 and 4 detected by the operation amount sensors 45 and 46, and the drive direction thereof, and the substitution of the engine rotational speed εE . . . into this selected function allows the differential pressure ΔPLS of Formula (7) to be determined. Meanwhile, the differential pressure maximum value $\Delta PLS_{max}$ is determined based on the selected work mode (M1 . . . ), the type of currently driven actuators 3 and 4 detected by the operation amount sensors 45 and 46, and the drive direction thereof, the smaller differential pressure ΔPLS is determined by Formula (8), and a control signal is output to the control valve 36 so that this determined differential pressure ΔPLS is obtained. Meanwhile, a control signal for obtaining the set absorbing torque τ (εE, εTH) is output to the torque control valve 47, and the swash plate 2*a* is controlled by the torque control valve 47 so that the absorbing torque τ is not exceeded.

The operating characteristics (a) and (c) of FIG. 2 express the relationship between the operation amounts S1 and S2 and the work machine actuator drive velocities v1 and v2 for cases in which the load is low and cases in which the load is high, respectively, according to this ninth control; since the differential pressure ΔPLS decreases as the load Pp increases according to Formula (7), there is no shift from the characteristics (a) to the characteristics (b), in which there is a considerable dead band, even when the load Pp is high, but there is a shift towards the characteristics (c), in which there is a low gradient, so that the dead band is kept low, as is the case with characteristics (a), in which the load Pp is low, and good operability is maintained. Moreover, since the equivalent horsepower control of the absorbing torque of the hydraulic pump 2 is effected at the same time, no inconveniences such as engine failure occur. The characteristics (b) shown by the dotted line in FIG. 2, furthermore, depict cases in which control is not effected based on Formula (7), from which it is seen that the dead band is enlarged and the operability is degraded due to a torque limitation encountered when the load is high.

Tenth Control

With the ninth control, the differential pressure ΔPLS is varied according to Formula (7), and good operability that is suitable for the load currently on the work machine can thus be obtained; with this tenth control, however, the aim is to realize highly precise control by correcting the load Pp of Formula (7).

FIG. 11(*c*) shows the relationship between the pump discharge pressure Pp and the pump discharge quantity Q; since the PQ curve is generally approached as the sum total A of the aperture areas decreases, i.e., as the operation amounts S1 and S2 of the operation levers decrease, variations in the actual pressure Pp result, as shown by G, in variations in the quantity Q, and thus in variations in the differential pressure, which has an adverse effect on operability.

Ultimately, as shown in FIG. 11(*a*), this tenth control allows the pump discharge pressure detected value Pp to be corrected so that the discharge pressure Pp' gradually increases, as shown by the dot-dash-dot line I and the dotted line H, as the aperture area sum total A decreases. In FIG. 11(*a*), the solid line J depicts the relationship between the detected value Pp and the corrected value Pp' when the aperture area sum total A is at its maximum value $A_{max}$; when the aperture area sum total A is at its maximum, there is no degradation in operability, and the detected value Pp is thus not corrected. When the aperture area sum total A is higher than the minimum value $A_{min}$ and lower than the maximum value $A_{max}$, correction is performed, as indicated by the dotted line H, and when the aperture area sum total A is at the maximum value $A_{max}$ then, as shown by the dot-dash-dot line I, the corrected value is made larger than in the case of the dotted line H, so as to cope with the degradation of operability.

The reason that the corrected value decreases as the detected value increases is that, since the variation width of the quantity Q decreases as the pump pressure Pp increases, as is clear from FIG. 11(*c*), the variation in the differential pressure decreases, and not that much correction is required.

The contents of FIG. 11(*a*) may be expressed, as FIG. 11(*b*), in which the relationship among the pump pressure detected value Pp, the aperture area sum total A, and the corrected value Pp' is represented as a three-dimensional map K, and correction may be carried out according to this three-dimensional map K.

Accordingly, with this tenth control, the contents of FIG. 11(*a*) or FIG. 11(*b*) are stored in advance in the memory, not shown in the figures, in the controller 33. The corresponding corrected value Pp' in FIG. 11(*a*) or FIG. 11(*b*) may thus be fetched based on the detected value Pp of the pump pressure sensor 44 and the detected values S1 and S2 of the operation amount sensors 45 and 46. In this case, the aperture area sum total A may be determined from the sum total of the operation amounts S1 and S2, or may be determined to be the larger of the operation amounts S1 and S2.

The thus obtained corrected value Pp' is then used to correct Formula (8) to Formula (9) below.

$$\Delta PLS=\min(\{\epsilon E\ \tau/(k\ Pp'\ A)\}2,\ \Delta PLS_{max}) \quad (9)$$

A control signal for obtaining this corrected differential pressure ΔPLS is then output to the control valve 36. As a result, operability in the micro velocity region of the operation levers is further improved.

Eleventh Control

With the ninth control, the differential pressure ΔPLS is varied according to Formula (7), and good operability that suits the load currently on the work machine can thus be obtained, but this eleventh control allows precise control to be effected by correcting the absorbing torque τ in Formula (7).

Formula (7) is a formula for determining the differential pressure ΔPLS so that the absorbing torque τ on the PQ curve is not exceeded. Therefore, when the operation lever operation amounts are low in which the horsepower limitation due to the PQ curve is not encountered, the engine output and the pump load are matched at a torque no more than the absorbing torque τ (maximum value) and thus a flow rate corresponding to the lever stroke can be fed. It is therefore managed to correct the torque τ in Formula (7) to τ' so that the absorbing torque will decrease as the operation amount detected values S1 and S2 decrease.

With this eleventh control, therefore, a calculation formula or the like for determining the corrected value τ' so that the torque τ is decreased as the aperture area sum total detected value A decreases is stored in advance in the memory, not shown in the figures, in the controller 33. The corrected value τ' is thus calculated based on the contents of the memory and on the detected values S1 and S2 of the operation amount sensors 45 and 46. In this case, the aperture area sum total A may be determined from the sum total of the operation amounts S1 and S2, or it may be taken as the larger of the operation amounts S1 and S2.

The corrected torque τ' is thus used to correct Formula (8) to Formula (10), whereby the corrected differential pressure ΔPLS can be found.

$$\Delta PLS=(\{\epsilon E\cdot\tau'/(k\cdot Pp'\cdot A)\}2,\ \Delta PLS_{max}) \quad (10)$$

A control signal for obtaining this corrected differential pressure ΔPLS is thus output to the control valve 36, and operability in the micro velocity region is further improved.

As described above, according to this embodiment, the engine rotational speed, hydraulic pump discharge pressure, and operation valve operation amounts are each detected, the absorbing torque of the hydraulic pump is set, and the differential pressure ΔPLS is varied based on a specific relationship that is established among these detected values, the set torque, and the differential pressure ΔPLS; it is thus possible to realize optimal lever operability suitable for the present working conditions, and thus possible to remarkably improve the working efficiency.

This embodiment, furthermore, has been explained assuming cases in which, as shown in FIG. 7(*c*), the hydraulic pump 2 is subjected to equivalent horsepower control; however, this embodiment can of course also be applied to cases in which the hydraulic pump 2 is subjected to fixed torque control, as long as it is control that allows the engine output torque and the hydraulic pump absorbing torque to be matched.

INDUSTRIAL APPLICABILITY

As described above, according to this invention, the differential pressure is varied according to, among other things, the load on the work machine actuators, an optimal lever operability suitable for the current working conditions can be realized, and a working efficiency is drastically improved compared to that in the past.

According to this invention, moreover, the differential pressure is varied so that the differential pressure decreases as the load on the work machine actuators increases, and as the engine rotational speed decreases, and this makes it possible to avoid the effects of pressure oil leakage and to maintain good operability. According to this invention, moreover, the differential pressure is varied so that, when the operation valve is in a neutral position, the differential pressure decreases than when the operation valve is operated, and so that the differential pressure decreases as the engine rotational speed increases; this improves the operability when operation lever operation is begun, and also improves the working efficiency.

According to this invention, moreover, the differential pressure is controlled while the engine output torque and the hydraulic pump absorbing torque are matched; this eliminates inconveniences such as engine failure, and simultaneously improves operability.

According to this invention, moreover, since the differential pressure is controlled while the engine output torque and the hydraulic pump absorbing torque are matched, inconveniences such as engine failure are eliminated and, at the same time, the operability is improved.

We claim:

1. A controller for a hydraulic drive machine, which has a hydraulic pump driven by a motor, a plurality of hydraulic actuators driven by the supply of discharge pressure oil of the hydraulic pump via a pressure oil supply line, and a plurality of flow rate control valves for controlling, in accordance with operation amounts, a flow rate of the pressure oil supplied to the plurality of work machine actuators; and which controls a discharge flow rate of the hydraulic pump so that a differential pressure between a discharge pressure of the hydraulic pump and a load pressure of the plurality of work machine actuators becomes a set value, characterised in that the controller comprises:

pressure detection means for detecting the discharge pressure of the hydraulic pump or the load pressure of the plurality of work machine actuators throughout a pressure operating range; and means for varying the differential pressure set value substantially throughout the pressure operating range so that the differential pressure set value decreases as the pressure detected by the pressure detection means increases.

2. A controller for a hydraulic drive machine, which has a hydraulic pump driven by a motor, a plurality of hydraulic actuators driven by the supply of discharge pressure oil of the hydraulic pump via a pressure oil supply line, and a plurality of flow rate control valves for controlling, in accordance with operation amounts, a flow rate of the pressure oil supplied to the plurality of work machine actuators; and which controls a discharge flow rate of the hydraulic pump so that a differential pressure between a discharge pressure of the hydraulic pump and a load pressure of the plurality of work machine actuators becomes a set value, characterised in that the controller comprises:

pressure detection means for detecting the discharge pressure of the hydraulic pump or the load pressure of the plurality of work machine actuators;

operation amount detection means for detecting the operation amounts of the plurality of flow rate control valves; and means for varying the differential pressure set value so that the differential pressure set value decreases as the pressure detected by the pressure detection means increases, and for varying the differential pressure set value so that the differential pressure set value decreases as the operation amounts detected by the operation amount detection means increase, while the differential pressure set value determined by the pressure detection means is being taken as a minimum value.

3. A controller for a hydraulic drive machine, which has a hydraulic pump driven by a motor, a plurality of hydraulic actuators driven by the supply of a discharge pressure oil of the hydraulic pump via a pressure oil supply line, and a plurality of flow rate control valves for controlling, in accordance with operation amounts, a flow rate of the pressure oil supplied to the plurality of work machine actuators; and which controls a discharge flow rate of the hydraulic pump so that a differential pressure between a discharge pressure of the hydraulic pump and a load pressure of the plurality of work machine actuators becomes a set value, characterised in that the controller comprises:

pressure detection means for detecting the discharge pressure of the hydraulic pump or the load pressure of the plurality of work machine actuators;

operation amount detection means for detecting the operation amounts of the plurality of flow rate control valves;

work machine type detection means for detecting the type of work machine actuator currently being driven from among the plurality of work machine actuators; and means for varying the differential pressure set value based on the type of work machine actuator detected by the work machine type detection means, on the operation amounts detected by the operation amount detection means, and on the pressure detected by the pressure detection means.

4. The controller as defined in claim 3, characterised in that the work machine detection means detects the type of work machine actuator by detecting operating conditions of the plurality of flow rate control valves.

5. A controller for a hydraulic drive machine, which has a hydraulic pump driven by a motor, a plurality of hydraulic actuators driven by the supply of a discharge pressure oil of the hydraulic pump via a pressure oil supply line, and a plurality of flow rate control valves for controlling, in accordance with operation amounts, a flow rate of the pressure oil supplied to the plurality of work machine actuators; and which controls a discharge flow rate of the hydraulic pump so that a differential pressure between the discharge pressure of the hydraulic pump and a load pressure of the plurality of work machine actuators becomes a set value, characterised in that the controller comprises:

pressure detection means for detecting the discharge pressure of the hydraulic pump or the load pressure of the plurality of work machine actuators;

rotational speed detection means for detecting a rotational speed of the motor; and means for varying the differential pressure set value so that the differential pressure set value increases as the rotational speed detected by rotational speed detection decreases and the pressure detected by the pressure detection means increases.

6. A controller for a hydraulic drive machine, which has a hydraulic pump driven by a motor, a plurality of hydraulic actuators driven by the supply of a discharge pressure oil of the hydraulic pump via a pressure oil supply line, and a plurality of flow rate control valves for controlling, in accordance with operation amounts, a flow rate of the pressure oil supplied to the plurality of work machine actuators; and which controls a discharge flow rate of the hydraulic pump so that the differential pressure between a discharge pressure of the hydraulic pump and a load pressure of the plurality of work machine actuators becomes a set value, characterised in that the controller comprises:

neutral position detection means for detecting a fact that operating positions of the plurality of flow rate control valves have reached neutral positions;

rotational speed detection means for detecting the rotational speed of the motor; and means for varying the differential pressure set value, when the operating positions of all of the plurality of flow rate control valves have been detected as being in neutral positions by the neutral position detection means, so that the differential pressure set value is less than a differential pressure set value being set for a case when any of the plurality of flow rate control valves is being operated, and so that the differential pressure set value decreases as the rotational speed detected by the rotational speed detection means increases.

7. A controller for a hydraulic drive machine, which has a hydraulic pump driven by a motor, a plurality of hydraulic actuators driven by the supply of a discharge pressure oil of the hydraulic pump via a pressure oil supply line, and a plurality of flow rate control valves for controlling, in accordance with operation amounts, a flow rate of the pressure oil supplied to the plurality of work machine actuators; and which controls a discharge flow rate of the hydraulic pump so that a differential pressure between a discharge pressure of the hydraulic pump and a load pressure of the plurality of work machine actuators becomes a set value, characterised in that:

the rotational speed of the motor and either the discharge pressure of the hydraulic pump or the load pressure of the work machine actuators and the operation amounts of the plurality of flow rate control valves are detected, respectively, an absorbing torque of the hydraulic pump is set based on a target rotational speed of the motor, and the differential pressure is varied in accordance with each of the detected values and the set value.

8. The controller as defined in claim 7, characterised in that the pressure detected value is corrected so that the load pressure of the plurality of work machine actuators or the discharge pressure of the hydraulic pump increases as the detected values of the operation amounts of the plurality of flow rate control valves decrease, and the differential pressure set value is varied according to the corrected pressure.

9. The controller as defined in claim 7, characterised in that the absorbing torque set value is corrected so that the absorbing torque of the hydraulic pump decreases as the detected values of the operation amounts of the plurality of flow rate control valves decrease, and the differential pressure set value is varied according to the corrected absorbing torque.

10. A controller for a hydraulic drive machine, which has a hydraulic pump driven by a motor, a plurality of hydraulic actuators driven by the supply of a discharge pressure oil of the hydraulic pump via a pressure oil supply line, and a plurality of flow rate control valves for controlling, in accordance with operation amounts, a flow rate of the pressure oil supplied to the plurality of work machine actuators; and which controls a discharge flow rate of the hydraulic pump so that a differential pressure between a discharge pressure of the hydraulic pump and a load pressure of the plurality of work machine actuators becomes a set value, characterised in that the controller comprises:

work type designation means for selecting and designating the type of work performed by the hydraulic drive machine;

rotational speed detection means for detecting the rotational speed of the drive machine;

pressure detection means for detecting the load pressure of the plurality of work machine actuators or the discharge pressure of the hydraulic pump;

operation amount detection means for detecting the operation amounts of the plurality of flow rate control valves;

work machine type detection means for detecting the type of work machine actuator currently being driven from among the plurality of work machine actuators;

torque setting means for setting a absorbing torque of the hydraulic pump based on the type of work machine actuator detected by the work machine type detection means, the type of work designated by the work type designation means, and a target rotational speed of the motor; and characterised in that the differential pressure set value is varied according to a torque set value set by the torque setting means and each of the detected values detected by the respective detection means.

11. A controller for a hydraulic drive machine, which has a hydraulic pump driven by a motor, a plurality of hydraulic actuators driven by the supply of a discharge pressure oil of the hydraulic pump via a pressure oil supply line, and a plurality of flow rate control valves for controlling, in accordance with operation amounts, a flow rate of the pressure oil supplied to the plurality of work machine actuators; and which controls a discharge flow rate of the hydraulic pump so that a differential pressure between a discharge pressure of the hydraulic pump and a load pressure of the plurality of work machine actuators becomes a set value, characterised in that the controller comprises:

rotational speed detection means for detecting a rotational speed of the motor;

discharge pressure detection means for detecting the discharge pressure of the hydraulic pump;

load pressure detection means for detecting the load pressure of the plurality of work machine actuators;

operation amount detection means for detecting the operation amounts of the plurality of flow rate control valves;

a controller for setting an absorbing torque of the hydraulic pump based on a target rotational speed of the motor, for setting the differential pressure based on the operation amount detected values of the operation amount detection means, on the pressure detected value of the load pressure detection means or the discharge pressure detection means, on the rotational speed detected value of the rotational speed detection means, and on the set absorbing torque, and for outputting control signals corresponding to the absorbing torque set value and the differential pressure set value;

a torque control valve for controlling a swash angle of a swash plate of the hydraulic pump, so that the absorbing torque set value is obtained, based on inputs from the controller of a control signal corresponding to the absorbing torque set value and a detection signal corresponding to the discharge pressure detected value of the discharge pressure detection means; and a differential pressure control valve for controlling the swash angle of the swash plate of the hydraulic pump, so that the differential pressure set value is obtained, based on the input from the controller of a control signal corresponding to the differential pressure set value, and on the input of detected signals corresponding to the pressure detected values of the load pressure detection means and the discharge pressure detection means.

12. The controller as defined in claim 11, characterised in that the controller corrects the pressure detected value of the discharge pressure or the load pressure so that the discharge pressure or the load pressure increases as the detected values of the operation amounts of the plurality of flow rate control valves decrease, and sets the differential pressure according to the corrected pressure.

13. The controller as defined in claim 11, characterised in that the controller corrects the absorbing torque set value so that the absorbing torque of the hydraulic pump decreases as the detected values of the operation amounts of the plurality of flow rate control valves decrease, and sets the differential pressure according to the corrected absorbing torque.

14. A controller for a hydraulic drive machine, which has a hydraulic pump driven by a motor, a plurality of hydraulic actuators driven by the supply of a discharge pressure oil of the hydraulic pump via a pressure oil supply line, and a plurality of flow rate control valves for controlling, in accordance with operation amounts, a flow rate of the pressure oil supplied to the plurality of work machine actuators; and which controls a discharge flow rate of the hydraulic pump so that a differential pressure between a discharge pressure of the hydraulic pump and a load pressure of the plurality of work machine actuators becomes a set value, characterised in that the controller comprises:

work type designation means for selecting and designating the type of work performed by the hydraulic drive machine;

rotational speed detection means for detecting a rotational speed of the motor;

discharge pressure detection means for detecting the discharge pressure of the hydraulic pump;

load pressure detection means for detecting the load pressure of the plurality of work machine actuators;

operation amount detection means for detecting the operation amounts of the plurality of flow rate control valves;

work machine type detection means for detecting the type of work machine actuator currently being driven from among the plurality of work machine actuators;

a controller for setting an absorbing torque of the hydraulic pump based on the type of work machine actuator detected by the work machine type detection means, the type of work designated by the work type designation means, and a target rotational speed of the motor; for setting the differential pressure based on the operation amount detected values of the operation amount detection means, the pressure detected values of the load pressure detection means or the discharge pressure detection means, and the set absorbing torque; and for outputting control signals corresponding to the absorbing torque set value and the differential pressure set value;

a torque control valve for controlling a swash angle of a swash plate of the hydraulic pump, so that the absorbing torque set value is obtained, based on an input from the controller of a control signal corresponding to the absorbing torque set value, and on an input of a detected signal corresponding to the discharge pressure detected value of the discharge pressure detection means; and a differential pressure control valve for controlling the swash angle of the swash plate of the hydraulic pump, so that the differential pressure set value is obtained, based on the input from the controller of a control signal corresponding to the differential pressure set value, and on the input of detected signals corresponding to the pressure detected values of the load pressure detection means and the discharge pressure detection means.

* * * * *

UNITED STATES PATENT AND TRADEMARK OFFICE

CERTIFICATE OF CORRECTION

PATENT NO. : 5,630,317

DATED : May 10, 1997

INVENTOR(S) : Takamura et al.

It is certified that error appears in the above-indentified patent and that said Letters Patent is hereby corrected as shown below:

Column 8, line 51, delete "is", first occurrence; delete "in", first occurrence.

Column 11, line 63, delete "th" and insert --the--.

Column 15, line 20, delete "speed$\epsilon$E" and insert --speed $\epsilon$E--.

Column 16, line 52, delete "i" and insert --1--.

Column 17, line 11, delete "($\tau$E·$\epsilon$TH)" and insert --($\epsilon$E·$\epsilon$TH)--.

Column 18, line 54, delete ".as" and insert --as--.

Column 21, line 19, delete "i" and insert --1--.

Column 27, line 66, delete "a" and insert --an--.

Signed and Sealed this

Twenty-third Day of June, 1998

*Attest:*

*Attesting Officer*

BRUCE LEHMAN

*Commissioner of Patents and Trademarks*